US007396626B2

(12) United States Patent
Fujikawa et al.

(10) Patent No.: US 7,396,626 B2
(45) Date of Patent: Jul. 8, 2008

(54) TONER

(75) Inventors: Hiroyuki Fujikawa, Yokohama (JP); Nobuyoshi Sugahara, Toride (JP); Takayuki Itakura, Mishima (JP); Naoki Okamoto, Mishima (JP); Koh Ishigami, Mishima (JP); Yoshinobu Baba, Yokohama (JP); Hirohide Tanikawa, Sunto-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 364 days.

(21) Appl. No.: 11/225,064

(22) Filed: Sep. 14, 2005

(65) Prior Publication Data

US 2006/0008723 A1 Jan. 12, 2006

Related U.S. Application Data

(63) Continuation of application No. PCT/JP2005/008572, filed on Apr. 28, 2005.

(30) Foreign Application Priority Data

Apr. 28, 2004 (JP) ..... 2004-132899

(51) Int. Cl.
*G03G 9/087* (2006.01)

(52) U.S. Cl. ..... 430/108.6; 430/109.4

(58) Field of Classification Search ..... 430/108.6, 430/109.4

See application file for complete search history.

(56) References Cited

U.S. PATENT DOCUMENTS

| | | | | |
|---|---|---|---|---|
| 6,346,070 | B1 | 2/2002 | Ohmatsuzawa et al. | 529/279 |
| 6,451,959 | B1 | 9/2002 | Ohmatsuzawa et al. | 528/279 |
| 7,049,041 | B2 * | 5/2006 | Kishiki et al. | 430/109.4 |
| 2002/0137879 | A1 | 9/2002 | Ohmatsuzawa et al. | 528/279 |
| 2004/0254331 | A1 * | 12/2004 | Minobe et al. | 528/279 |
| 2005/0026056 | A1 | 2/2005 | Fujikawa et al. | 430/45 |

FOREIGN PATENT DOCUMENTS

| | | |
|---|---|---|
| JP | 53-109597 | 9/1978 |
| JP | 54-125296 | 9/1979 |
| JP | 01-185660 | 7/1989 |
| JP | 01-238672 | 9/1989 |
| JP | 04-107467 | 4/1992 |
| JP | 04-149559 | 5/1992 |
| JP | 04-301853 | 10/1992 |
| JP | 05-61238 | 3/1993 |
| JP | 05-279465 | 10/1993 |
| JP | 2001-64378 | 3/2001 |
| JP | 2001-278971 | 10/2001 |
| JP | 2002-148867 | 5/2002 |
| JP | 2004-004657 | 1/2004 |
| JP | 2004-004806 | 1/2004 |
| JP | 2004-117957 | 4/2004 |
| JP | 2004-117958 | 4/2004 |
| JP | 2004-118180 | 4/2004 |
| JP | 2004-126383 | 4/2004 |
| JP | 2005-091525 | 4/2005 |
| JP | 2005-091696 | 4/2005 |
| JP | 2005-091881 | 4/2005 |

* cited by examiner

*Primary Examiner*—John L Goodrow
(74) *Attorney, Agent, or Firm*—Fitzpatrick, Cella, Harper & Scinto

(57) ABSTRACT

The present invention provides a toner improved in dispersibility of a colorant in the toner particles and excellent in the color reproducibility including color mixability and transparency. The toner is also excellent in the stability in long-term of the chargeability and capable of forming images maintaining high image quality. The present invention provides a toner for forming a full-color image which includes at least toner particles containing a binder resin, a colorant and a wax, and inorganic fine particles, wherein the binder resin comprises a resin having polyester units which is synthesized by use of an aromatic carboxylic acid titanium compound as a catalyst, and the inorganic fine particles comprise fine titanium oxide particles.

6 Claims, 2 Drawing Sheets

TONER

This application is a continuation of International Application No. PCT/JP2005/008572, filed Apr. 28, 2005, which claims the benefit of Japanese Patent Application No. 2004-132899, filed Apr. 28, 2004.

BACKGROUND OF THE INVENTION

1. Field of the Invention

The present invention relates to a toner for use in an electrophotographic method, an electrostatic recording method, an electrostatic printing method, a toner jet recording method and a magnetic recording method.

2. Related Background Art

As electrophotography color image forming apparatus have become widely used, the application purposes thereof are extended variously, creating a severe demand on image quality. When copying images such as common photographs, catalogs and maps, even fine details are demanded to be finely and faithfully reproduced, and accordingly demand for vividness of color is also growing and the color reproduction range is demanded to be extended. In particular, under the current circumstances such that electrophotography has been significantly adopted in the field of printing, electrophotography itself is demanded to have high definition, high fineness, graininess and the like equal to or higher than those involved in the printing quality.

Full color image copying machines having been proposed in these years generally adopt a method in which a plurality of photosensitive members are used, electrostatic charge images formed on the photosensitive members are developed respectively by use of a cyan toner, a magenta toner, a yellow toner and a black toner, thereafter the toner images are successively transferred onto a transfer material conveyed along a straight path between the photosensitive members and a belt-form transfer member to form a full-color image, or a method in which a transfer material is wound, with the aid of electrostatic force or a mechanical action exerted by grippers, around the surface of a transfer member which faces a photosensitive member, and a development-transfer cycle is repeated four times to form a full-color image.

Toners used in such full-color image copying machines are required to exhibit an improved color reproducibility and to permit a sufficient color mixing of the respective toners in a heat-pressure fixing to ensure satisfactory transparency for overhead projector (OHP) images to be heat fixed onto transfer materials. In order to satisfy such requirements, a resin having a sharper melting property is preferably used, in this connection polyester resin having been used recently as a sharp-melting resin. As polymerization catalysts for producing polyester resins for use in toners, tin based catalysts such as dibutyltin oxide and antimony based catalysts such as antimony trioxide have been generally used. In order to realize performances required for full-color image copying machines such as high speed, high image quality and high fineness, important are such toner properties as fixing property including low temperature fixing property and high-temperature offset resistance, and color reproducibility including color mixability and transparency; however, polyester resins obtained by use of catalysts such as described above are still far from satisfying these toner properties.

Accordingly, Japanese Patent Applications Laid-Open Nos. 2002-148867 and 2001-64378 propose techniques in which a titanic acid ester of an aromatic diol and a solid titanium compound are used as polymerization catalysts. Japanese Patent Application Laid-Open No. H05-279465 proposes a technique in which a titanium tetraalkoxide treated with an organic monocarboxylic acid is used as a polycondensation catalyst for a polyester resin. However, these techniques still have problems with fixing property, color reproducibility and developing property when applied to toners for full-color image formation, and are therefore needed to be further improved.

When a sharp melting resin is used, a problem with high-temperature offset resistance usually tends to occur at the time of melting of the toner in the heat-pressure fixing step because the binder resin is low in self-cohesion. Accordingly, for the purpose of improving the high-temperature offset resistance at the time of fixing, relatively high-crystallinity waxes typified by polyethylene wax and polypropylene wax are used as releasing agents. However, because of the high crystallinity of the mold releasing agent and the difference in refractive index between the mold releasing agent and the OHP sheet material, such toners for full-color image formation sometimes lead to the degradation of transparency and the lowering of the chroma and brightness in the projected images when OHP projection is carried out.

For the purpose of solving these problems, Japanese Patent Applications Laid-Open Nos. H04-149559 and H04-107467 propose methods in which a nucleating agent is used together with a wax to lower the crystallinity of the wax. Japanese Patent Applications Laid-Open Nos. H04-301853 and H05-61238 propose methods in which a wax further lower in crystallinity is used (for example, see Patent Documents 6 and 7). Japanese Patent Applications Laid-Open Nos. H01-185660 and H01-238672 also propose the use of montan waxes as waxes, other than those described above, each having a relatively good transparency and a low melting point. However, such waxes cannot fully satisfy all the requirements, namely, the toner transparency in OHP sheets, and low-temperature fixing property and high-temperature offset resistance in the heat-pressure fixing.

SUMMARY OF THE INVENTION

The present invention has been developed to solve the problems involved in the above described conventional techniques. It is an object of the present invention to provide a toner excellent in fixing property and high-temperature offset resistance. It is another object of the present invention to provide a toner improved in the dispersibility of a colorant in the toner particles and excellent in color reproducibility including color mixability and transparency.

It is also another object of the present invention to provide a toner excellent in the stability in long-term of the chargeability and capable of forming images maintaining high image quality. It is also another object of the present invention to provide a toner high in the efficiency of the transfer from the photosensitive member to transfer materials such as paper and the transfer belt or from the transfer belt to paper.

The present inventors, as a result of a diligent investigation, has paid attention to a polyester resin synthesized with a particular polymerization catalyst, and has perfected the present invention by discovering that there can be obtained, by use of such a resin as a binder resin, a toner which can attain a desired dispersibility of a colorant and a wax in the toner particles and is excellent in the charge stability. In other words, the above described objects can be attained by using the following toner.

(1) A toner for forming a full-color image comprising at least:

toner particles containing a binder resin, a colorant and a wax, and inorganic fine particles, wherein:

the binder resin comprises a resin having polyester units which is synthesized by use of an aromatic carboxylic acid titanium compound as a catalyst; and the inorganic fine particles contain fine titanium oxide particles.

(2) The toner according to (1), wherein the inorganic fine particles further comprise fine silica particles.

(3) The toner according to (1) or (2), wherein the transmittance (%) thereof in an aqueous solution of 45% by volume of methanol falls within a range from 10% to 70%.

(4) The toner according to any of (1) to (3), wherein, in an endothermic curve thereof in differential scanning calorimetry (DSC), a temperature at which a maximum endothermic peak is exhibited in a temperature range from 30° C. to 200° C. falls within a range from 60° C. to 130° C.

(5) The toner according to any of (1) to (4), wherein the aromatic carboxylic acid titanium compound is a reaction product between an aromatic carboxylic acid and a titanium alkoxide.

(6) The toner according to (5), wherein the aromatic carboxylic acid is a di or more valent aromatic carboxylic acid and/or an aromatic oxycarboxylic acid.

(7) The toner according to (5), wherein the titanium alkoxide is a compound represented by the following general formula (1):

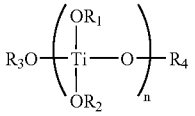

(1)

wherein $R_1$, $R_2$, $R_3$ and $R_4$ each are an alkyl group having 1 to 20 carbon atoms, and may be either the same or different from each other and optionally substituted; and n represents an integer of 1 to 10.

According to the present invention, a toner which is excellent in fixing property and high-temperature offset resistance, and excellent in the color reproducibility including color mixability and transparency because of the capability thereof of improving the dispersibility of the colorant in the toner particles can be provided. The toner of the present invention is excellent in the stability in long-term of the chargeability and thereby capable of forming images maintaining high image quality. The toner of the present invention is also excellent in the efficiency of the transfer from the photosensitive member to transfer materials such as paper and the transfer belt or from the transfer belt to paper.

DESCRIPTION OF THE PREFERRED EMBODIMENTS

Figure 1:
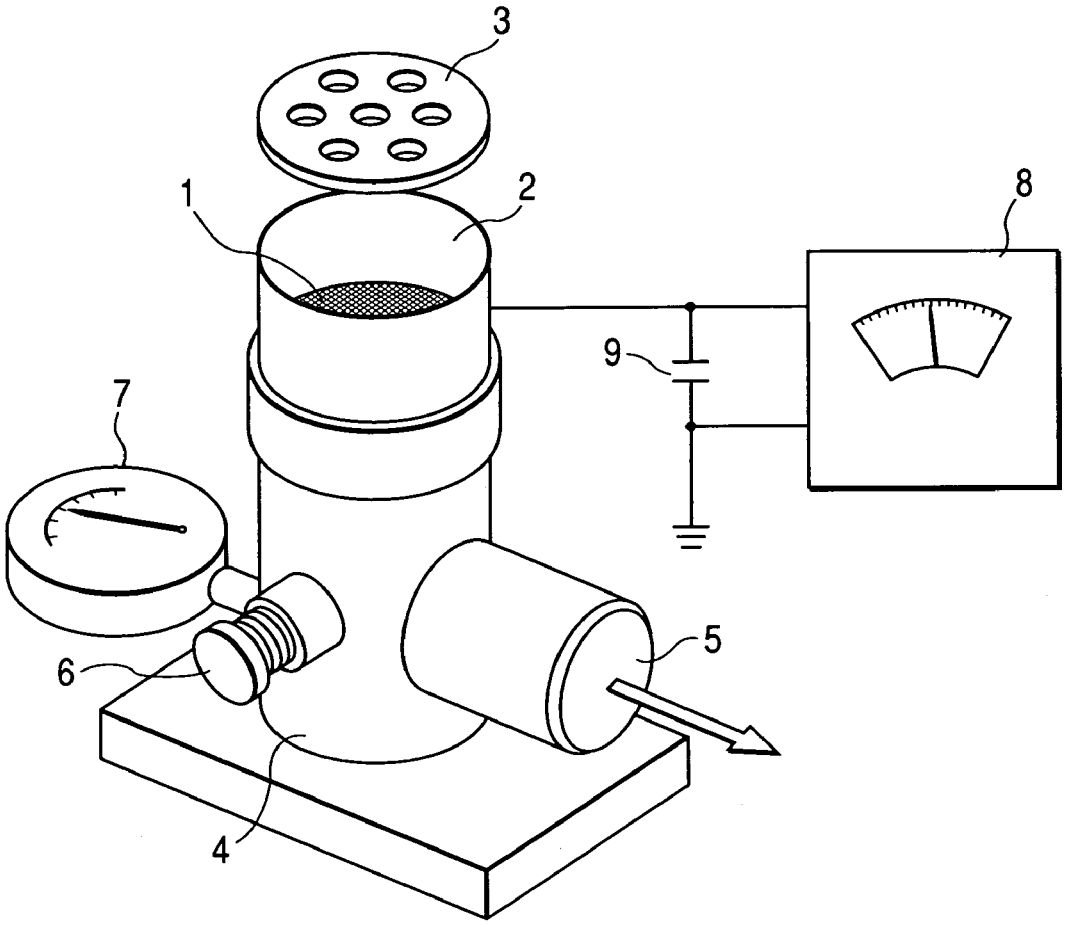
FIG. 1 is a schematic view of an apparatus for measuring the triboelectric charge quantity of a two-component developer.

The present invention will be described below in detail.

A toner according to the present invention is a toner to be used for a full-color image formation method, and includes at least a binder resin, a colorant and inorganic fine particles and a wax. The toner is also characterized in that the binder resin contained therein includes a resin including at least polyester units which is synthesized by use of an aromatic carboxylic acid titanium compound as a catalyst.

In the present invention, "a polyester unit" means a polymer portion having an ester bond formed by the reaction between an acid and an alcohol. Also in the present invention, "a resin having polyester units" means a resin having such polyester units, namely, a resin including repeating units each having at least an ester bond. Specifically, such a polyester unit is constituted of an alcoholic monomer component such as a di or more valent alcohol and an acid monomer component such as a di or more valent carboxylic acid, an anhydride of a di or more valent carboxylic acid or an ester of a di or more valent carboxylic acid. The toner of the present invention is characterized by using as binder resin a resin (for example a polyester resin or a hybrid resin) having portions polycondensed by using, as a part of the raw material thereof, the alcoholic monomer component and the acid monomer component constituting the polyester unit.

The binder resin to be used in the present invention is preferably any one selected from the group consisting of a polyester resin, a hybrid resin having polyester units and vinyl polymer units, a mixture composed of the hybrid resin and a vinyl polymer, a mixture composed of the hybrid resin and a polyester resin, a mixture composed of a polyester resin, the hybrid resin and a vinyl polymer, and a mixture composed of a polyester resin and a vinyl polymer. In the present invention, "a vinyl polymer unit" means a polymer portion formed by polymerization of vinyl monomers, and "a resin having vinyl polymer units" means a resin having portions formed by vinyl polymerization of vinyl monomers.

The hybrid resin is obtained by transesterification between a polyester unit component and a vinyl polymer unit obtained by polymerizing a monomer component having a carboxylate group such as a (meth)acrylate group. Such a hybrid resin may preferably assume a form of a graft copolymer (or a block copolymer) including the vinyl polymer as a trunk polymer and the polyester unit as the branch polymer.

Specific examples of a di or more valent alcohol monomer component to constitute the polyester unit component may include the following compounds. Examples of a divalent alcohol monomer component may include: bisphenol A alkylene oxide adducts, such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, polyoxypropylene(6)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A and hydrogenated bisphenol A.

Examples of a tri or more valent alcoholic monomer component may include: sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Examples of the divalent carboxylic acid monomer components of the acid monomer components constituting the polyester unit in the present invention may include: aromatic dicarboxylic acids, such as phthalic acid, isophthalic acid and terephthalic acid, and the anhydrides thereof; alkyldicarboxylic acids, such as succinic acid, adipic acid, sebacic acid and azelaic acid, and the anhydrides thereof; succinic acids substituted with an alkyl or alkenyl group having 6-18 carbon atoms, and the anhydrides thereof; and unsaturated dicarboxylic acids, such as fumaric acid, maleic acid and citraconic acid, and the anhydrides thereof.

Examples of the tri or more valent carboxylic acid monomer component may include: polyvalent carboxylic acid such as trimellitic acid, pyromellitic acid, benzophenone tetracarboxylic acid and the anhydrides thereof. Examples of other monomers may include polyvalent alcohols such as oxyalkyleneether of a novolac phenolic resin.

The resins, formed as polycondensates between the polyester unit components particularly including a bisphenol derivative represented by the general formula (2) shown below as the divalent alcohol monomer component and a carboxylic acid component selected as the acid monomer component selected from the group consisting of di or more valent carboxylic acids, the anhydrides thereof and the lower alkyl esters thereof (for example, fumaric acid, maleic acid, maleic anhydride, phthalic acid, terephthalic acid, trimellitic acid, and pyromellitic acid) are preferred because they each exhibit a satisfactory chargeability:

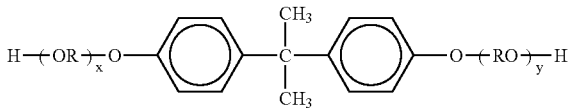

wherein R denotes an ethylene or propylene group, and x and y are independently a positive integer of at least 1 with the proviso that the average of x+y falls in a range from 2 to 10.

No particular constraint is imposed on the binder resin contained in the toner of the present invention as long as it is a resin having at least polyester units. For the purpose of exhibiting the advantageous effect of the present invention, the content of the polyester units in the whole binder resin is preferably 30% by mass or more in relation to the whole binder resin, more preferably 40% by mass or more, and particularly preferably 50% by mass or more.

When the content of the polyester unit component contained in the whole binder resin is 30% by mass or more in relation to the whole binder resin, the dispersibility of the colorant in the toner particles is improved and there is attained an excellent color reproducibility including color mixability and transparency of the toner in a fixed image. A toner having a high covering power on the transfer material can also be obtained. In particular, when a toner adopting a colorant master batch having a large colorant content is used, the above described advantageous effect is exhibited in a higher extent.

Examples of the vinyl monomers for producing vinyl polymer units or vinyl polymers to be used in hybrid resins may include: styrene; styrene derivatives such as o-methylstyrene, m-methylstyrene, p-methylstyrene, α-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene and p-nitrostyrene; ethylenically unsaturated monoolefins such as ethylene, propylene, butylene and isobutylene; unsaturated polyenes such as butadiene and isoprene; halogenated vinyls such as vinyl chloride, vinylidene chloride, vinyl bromide and vinyl fluoride; vinyl esters such as vinyl acetate, vinyl propionate and vinyl benzoate; α-methylene aliphatic monocarboxylic acid esters, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate and phenyl acrylate; vinyl ethers such as vinyl methyl ether, vinyl ethyl ether and vinyl isobutyl ether; vinyl ketones such as vinyl methyl ketone, vinyl hexyl ketone and methyl isopropenyl ketone; N-vinyl compounds such as N-vinylpyrrole, N-vinylcarbazole, N-vinylindole and N-vinylpyrrolidone; vinylnaphthalenes; and acrylic acid derivatives or methacrylic acid derivatives, such as acrylonitrile, methacrylonitrile and acrylamide.

Examples of the vinyl monomers concerned may also include the following carboxyl group-containing vinyl monomers: unsaturated dibasic acids, such as maleic acid, citraconic acid, itaconic acid, alkenylsuccinic acid, fumaric acid and mesaconic acid; unsaturated dibasic acid anhydrides, such as maleic anhydride, citraconic anhydride, itaconic anhydride and alkenylsuccinic anhydride; unsaturated dibasic acid half esters, such as monomethyl maleate, monoethyl maleate, monobutyl maleate, monomethyl citraconate, monoethyl citraconate, monobutyl citraconate, monomethyl itaconate, monomethyl alkenylsuccinate, monomethyl fumarate, and monomethyl mesaconate; unsaturated dibasic acid esters, such as dimethyl maleate and dimethyl fumarate; α,β-unsaturated acids such as acrylic acid, methacrylic acid, crotonic acid and cinnamic acid; α,β-unsaturated acid anhydrides such as crotonic anhydride, and cinnamic anhydride; anhydrides between such an α,β-unsaturated acid and a lower aliphatic acid; alkenylmalonic acid, alkenylglutaric acid, alkenyladipic acid, and anhydrides and monoesters of these acids.

Examples of the vinyl monomers concerned may also include the following hydroxy group-containing vinyl monomers: acrylic or methacrylic acid esters, such as 2-hydroxyethyl acrylate, 2-hydroxyethyl methacrylate and 2-hydroxypropyl methacrylate; and 4-(1-hydroxy-1-methylbutyl) styrene and 4-(1-hydroxy-1-methylhexyl)styrene.

The vinyl polymers and the vinyl polymer units used for the hybrid resins may have cross-linked structure formed with cross-linking agents having two or more vinyl groups. Examples of the cross-linking agents to be used in this case may include: aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and the compounds obtained by replacing the acrylate groups in the above compounds with methacrylate groups; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and the compounds obtained by replacing the acrylate groups in the above compounds with methacrylate groups; and diacrylate compounds connected with a chain including an aromatic group and an ether bond, such as polyoxyethylene(2)-2,2-bis(4-hydroxyphenyl)propane diacrylate, polyoxyethylene(4)-2,2-bis(4-hydroxyphenyl)propane diacrylate, and the compounds obtained by replacing the acrylate groups in the above compounds with methacrylate groups.

Examples of the cross-linking agents may also include: polyfunctional cross-linking agents, such as pentaerythritol triacrylate, trimethylolethane triacrylate, trimethylolpropane triacrylate, tetramethylolmethane tetracrylate, oligoester acrylate, and the compounds obtained by replacing the acrylate groups in the above compounds with methacrylate groups; and triallyl cyanurate and triallyl trimellitate.

It is preferable that the hybrid resin used in the present invention include monomer components in a vinyl polymer or a vinyl polymer unit and/or a polyester resin or a polyester unit, the monomer components being capable of reacting with these two resin components. Examples of the monomers capable of reacting with the vinyl polymer or the vinyl polymer unit, among the monomers constituting the polyester resin or the polyester unit, may include: unsaturated dicarboxylic acids, such as phthalic acid, maleic acid, citraconic acid and itaconic acid, and the anhydrides thereof. Examples of the monomers capable of reacting with the polyester resin or the polyester unit, among the monomers constituting the vinyl polymer or the vinyl polymer unit, may include: carboxyl group-containing or hydroxy group-containing monomers, and acrylic and methacrylic acid esters.

For the purpose of obtaining a hybrid resin as a reaction product between a vinyl polymer and a polyester resin, preferable is a method in which, in the presence of a polymer or a resin containing the above mentioned monomer components respectively capable of reacting with a vinyl polymer and a polyester resin, the hybrid resin is obtained by subjecting one or both of the polymer and the resin to polymerization reaction.

Examples of polymerization initiators for producing the vinyl polymer or the vinyl polymer unit of the present invention may include: 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, 2,2'-azobis(2-methyl-propane); ketone peroxides, such as methyl ethyl ketone peroxide, acetylacetone peroxide, and cyclohexanone peroxide; 2,2'-bis(t-butylperoxy)butane, t-butylhydroperoxide, cumene hydroperoxide, 1,1,3,3-tetramethylbutyl hydroperoxide, di-t-butyl peroxide, t-butyl cumyl peroxide, di-cumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, di-isopropyl peroxydicarbonate, di-2-ethylhexyl peroxydicarbonate, di-n-propyl peroxydicarbonate, di-2-ethoxyethyl peroxycarbonate, di-methoxyisopropyl peroxydicarbonate, di(3-methyl-3-methoxybutyl) peroxycarbonate, acetylcyclohexylsulfonyl peroxide, t-butyl peroxyacetate, t-butyl peroxyisobutyrate, t-butyl peroxyneodecanoate, t-butyl peroxy2-ethylhexanoate, t-butyl peroxylaurate, t-butyl peroxybenzoate, t-butyl peroxyisopropylcarbonate, di-t-butyl peroxyisophthalate, t-butyl peroxyallylcarbonate, t-amyl peroxy2-ethylhexanoate, di-t-butyl peroxyhexahydroterephthalate, and di-t-butyl peroxyazelate.

Examples of the production method for obtaining the hybrid resin to be used in the present invention may include the following methods (1) to (5):

(1) A vinyl resin and a polyester resin are separately produced and then dissolved/swollen in a small amount of organic solvent, added with an esterification catalyst and an alcohol, and then heated to carry out transesterification to synthesize a hybrid resin which has the polyester units and the vinyl polymer units.

(2) A vinyl polymer is produced in advance, and in the presence thereof, a polyester resin is produced to be reacted with the vinyl resin to produce a hybrid resin which has the polyester units and the vinyl polymer units. The hybrid resin may be produced through a reaction of the vinyl polymer (and a vinyl monomer which may be added according to need) with a polyester monomer (such as an alcohol and a carboxylic acid) and/or a polyester resin. Also in this case, an organic solvent may be optionally used.

(3) A polyester resin is produced in advance, and in the presence thereof, a vinyl polymer is produced to be reacted with the polyester resin to produce a hybrid resin which has the polyester units and the vinyl polymer units. The hybrid resin may be produced through a reaction of the polyester resin (and a polyester monomer which may be added according to need) with a vinyl monomer and/or a vinyl polymer.

(4) A vinyl polymer and a polyester resin are produced in advance, and in the presence of these polymer units, a vinyl monomer and/or a polyester monomer (an alcohol and a carboxylic acid) are added thereto to produce a hybrid resin component. Also in this case, an organic solvent may be optionally used.

(5) A vinyl monomer and a polyester monomer (an alcohol, a carboxylic acid and the like) are mixed together to successively effect addition polymerization and polycondesation to produce a mixture composed of a vinyl polymer, a polyester resin and a hybrid resin having polyester units and vinyl polymer units. Also in this case, an organic solvent may be optionally used.

In the above production methods (1) to (5), the vinyl copolymer unit and/or the polyester unit may respectively include a plurality of polymer units having different molecular weights and cross-linking degrees.

A hybrid resin component is produced in advance according to one of the above production methods (2) to (4), and then a vinyl monomer and/or a polyester monomer (an alcohol and a carboxylic acid) is added to the hybrid resin component to effect an addition polymerization and/or a polycondesation to produce a mixture composed of a vinyl polymer and/or a polyester resin, and the hybrid resin. In this case, a hybrid resin may be used which is produced as a hybrid resin component having the polyester units concerned and the vinyl polymer units concerned.

In the present invention, a vinyl polymer means a vinyl homopolymer or a vinyl copolymer; and a vinyl polymer unit means a vinyl homopolymer unit or a vinyl copolymer unit.

The toner of the present invention is characterized in that the resin contained in the binder resin and having polyester units is synthesized at least by use of an aromatic carboxylic acid titanium compound as a catalyst. The use of such a resin having polyester units makes it possible to obtain a toner which is improved in the dispersibility of the colorant in the toner particles, is excellent in the color reproducibility including toner mixability and transparency in a fixed image, and is high in covering power on the transfer material. In particular, when a toner adopting a colorant master batch having a large colorant content is used, the above described advantageous effect is exhibited in a higher extent.

Such an advantageous effect inherent to the present invention as described above is attained by synthesizing the resin used in the present invention, having polyester unit, by use of an aromatic carboxylic acid titanium compound as a catalyst. In the present invention, an aromatic carboxylic acid titanium compound is used as a catalyst when the resin having polyester units is produced, and accordingly, the aromatic carboxylic acid titanium compound is inevitably included in the resin having been produced. The content of the included aromatic carboxylic acid titanium compound may be assumed to be approximately equal to the used amount of the aromatic carboxylic acid titanium compound in the resin production. The advantageous effect is understood to be ascribable to the presence of such polyester units in the toner, in which the polyester resin incorporates the titanium atoms originated from the aromatic carboxylic acid titanium compound, the presence of such polyester units increasing the affinity between the binder resin and the colorant, and attaining the improvement effect of the dispersibility of the colorant in the resin. The inclusion of the titanium atoms, in the binder resin, originated from the aromatic carboxylic acid titanium compound can be identified by means of the methods well known in the art such as fluorescent X-ray analysis.

The toner of the present invention in which a specific resin having the above polyester units is used is excellent in the stability in long-term of the chargeability, and is small in the variation of the chargeability in long-term thereof for fast printing speed, so that the toner can maintain a high image quality throughout endurance application. The toner can also attain high transfer efficiency in a step for transferring the toner developed on the photosensitive member to a transfer material such as paper or a transfer drum and a step for transferring the toner from the transfer belt to paper.

These above described advantageous effects are attained by the stable chargeability of the toner particles, and may be ascribable to the appropriate charge relaxation property of the toner particles which is based on the stability of the charging ability owing to the improvement effect of the dispersibility of pigments and the like and is also based on the use of the polyester resin for which the aromatic carboxylic acid titanium compound is used as catalyst.

The aromatic carboxylic acid titanium compound used in the present invention is preferably a product of a reaction between an aromatic carboxylic acid and a titanium alkoxide. The aromatic carboxylic acid is preferably a di or more valent aromatic carboxylic acid (namely, an aromatic carboxylic acid having two or more carboxyl groups) and/or an aromatic oxycarboxylic acid.

Examples of the above described di or more valent aromatic carboxylic acids may include: dicarboxylic acids such as phthalic acid, isophthalic acid, and terephthalic acid and the anhydrides thereof; poly carboxylic acids such as trimellitic acid, benzophenone dicarboxylic acid, benzophenone tetracarboxylic acid, naphthalene dicarboxylic acid, and naphthalene tetracarboxylic acid, and the anhydrides and esterified compounds thereof. Examples of the above described aromatic oxycarboxylic acid may include: salicylic acid, m-oxybenzoic acid, p-oxybenzoic acid, gallic acid, mandelic acid, and tropic acid.

Among these carboxylic acids, di or more valent carboxylic acids, in particular, isophthalic acid, terephthalic acid, trimellitic acid and naphthalene dicarboxylic acid are preferably used as the aromatic carboxylic acid.

As the titanium alkoxide constituting the aromatic carboxylic acid titanium compound, the compound represented by the following general formula (1) is preferably used:

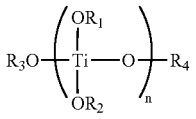

(1)

wherein $R_1$, $R_2$, $R_3$ and $R_4$ each are an alkyl group having 1 to 20 carbon atoms; these groups may be either the same or different from each other, and each may have one or more substituents; and n represents an integer of 1 to 10.

The $R_1$, $R_2$, $R_3$ and $R_4$ each are preferably an alkyl group having 1 to 10 carbon atoms. Specific examples of the titanium alkoxide having such a structure may include: titanium tetramethoxide, titanium tetraethoxide, titanium tetra-isopropoxide, titanium tetra-n-propoxide, titanium tetra-iso-butoxide, titanium tetra-n-butoxide, titanium tetra-t-butoxide, titanium tetrapentyloxide, titanium tetrahexyloxide, titanium tetraheptyloxide, titanium tetraoctyloxide, titanium tetranonyloxide, and titanium tetradecyloxide.

The titanium alkoxide used in the present invention is preferably a polytitanic acid ester in which n is 2 to 10 in the general formula (1). Specific examples thereof may preferably include tetra-n-butyl polytitanate, tetra-n-hexyl polytitanate, and tetra-n-octyl polytitanate. The aromatic carboxylic acid titanium compound used in the present invention can be obtained by reacting the above aromatic carboxylic acids with the above titanium alkoxides. Specifically, the above aromatic carboxylic acid titanium compound can be produced by hydrolyzing a titanium alkoxide in an alcohol solvent such as ethylene glycol to be reacted with an aromatic carboxylic acid.

The use of a polyester resin, produced by use of the above aromatic carboxylic acid titanium compound as a catalyst, improves the dispersibility of the colorant in the toner particles, so that there can be obtained a toner excellent in the color reproducibility including color mixability and transparency of the toner in a fixed image, and high in covering power on the transfer material. In particular, when a toner adopting a colorant master batch having a large colorant content is used, the above described advantageous effect is exhibited in a higher extent. Such an advantageous effect inherent to the present invention is understood to be ascribable to the presence of such polyester units in the toner, in which the polyester resin incorporates the titanium atoms originated from the aromatic carboxylic acid titanium compound, the presence of such polyester units increasing the affinity between the binder resin and the colorant, and attaining the improvement effect of the dispersibility of the colorant in the resin.

The use of the above toner of the present invention can also attain high transfer efficiency in a step for transferring the toner developed on the photosensitive member to a transfer material such as paper or a transfer drum and a step for transferring the toner from the transfer belt to paper.

Thus, there are attained the stability of the charging ability owing to the improvement effect of the dispersibility of pigments and the like created by the stable chargeability of the toner particles, and the appropriate charge relaxation property of the toner particles, through the use of the resin having the polyester units which is produced by use of the aromatic carboxylic acid titanium compound as a catalyst. Accordingly, there can be obtained a toner which is excellent in the stability in long-term of the chargeability and capable of manifesting images maintaining high image quality.

The addition amount of the aromatic carboxylic acid titanium compound to the resin is preferably 0.001% by mass or more and 2.0% by mass or less, and more preferably 0.005% by mass or more and 1.0% by mass or less, in relation to the total amount of the polyester unit component. When the addition amount of the aromatic carboxylic acid titanium compound is less than 0.001% by mass, the reaction time in the polyester polymerization is elongated, and the effect for improving the dispersibility of the colorant tends to be hardly obtainable. When the addition amount exceeds 2.0% by mass, the charging properties of the toner come to be affected and the charge quantity variation due to environments tends to be increased. In the production of the resin having polyester units, the above aromatic carboxylic acid titanium compound is used in such a way that the aromatic carboxylic acid titanium compound is added so as to be present when polymerizable monomers to constitute the resin are mixed.

In the production of the resin having polyester units to be contained in the toner of the present invention, the following compounds may be used as cocatalyst according to need, in addition to the aromatic carboxylic acid titanium compound.

Other types of titanium compounds may be added as cocatalyst, and preferably used are the compounds of the following elements: beryllium, magnesium, calcium, strontium, barium, titanium, zirconium, manganese, cobalt, zinc, boron, aluminum, gallium, phosphorus, tin and the like. Examples of the preferably used compounds of these elements may include the following compounds thereof: aliphatic acid salts such as acetates, carbonates, sulfates, nitrates, alkoxides, halides such as chlorides, acetylacetonates, oxides and the like. The following compounds are also preferably used: chelate compounds with dicarboxylic acids, dialcohols, oxycarboxylic acids and the like; reaction products between aromatic diols and alkoxides; and reaction products between organic monocarboxylic acids and alkoxides.

Among these compounds, preferably used are acetates, carbonates, alkoxides, halogen alkoxides, and acetylacetonates, and particularly preferably used are titanium alkoxide, titanium tetrachloride, zirconium alkoxide, magnesium carbonate, dicarboxylic acid chelate compounds of titanium, and magnesium acetate.

The coexistence of such a cocatalyst with the above aromatic carboxylic acid titanium compound preferably makes it possible to accelerate the progress of the polycondensation of the resin having polyester units. The cocatalyst is used in a range from 0.01% to 200% by mass in relation to the aromatic carboxylic acid titanium compound, according to the type of the cocatalyst used.

Table 1 lists specific examples of preferable combinations of the aromatic carboxylic acids and titanium alkoxides to constitute the aromatic carboxylic acid titanium compound used in the present invention.

TABLE 1

| Compound No. | Aromatic carboxylic acid | Titanium alkoxide |
|---|---|---|
| 1 | Isophthalic acid | Titanium tetramethoxide |
| 2 | Isophthalic acid | Titanium tetraethoxide |
| 3 | Isophthalic acid | Titanium tetra-i-propoxide |
| 4 | Isophthalic acid | Titanium tetra-n-propoxide |
| 5 | Isophthalic acid | Titanium tetra-i-butoxide |
| 6 | Isophthalic acid | Titanium tetra-n-butoxide |
| 7 | Isophthalic acid | Titanium tetra-t-butoxide |
| 8 | Isophthalic acid | Tetra-n-butyl polytitanate (n = 3) |
| 9 | Terephthalic acid | Titanium tetramethoxide |
| 10 | Terephthalic acid | Titanium tetraethoxide |

TABLE 1-continued

| Compound No. | Aromatic carboxylic acid | Titanium alkoxide |
|---|---|---|
| 11 | Terephthalic acid | Titanium tetra-i-propoxide |
| 12 | Terephthalic acid | Titanium tetra-n-propoxide |
| 13 | Terephthalic acid | Titanium tetra-i-butoxide |
| 14 | Terephthalic acid | Titanium tetra-n-butoxide |
| 15 | Terephthalic acid | Titanium tetra-t-butoxide |
| 16 | Terephthalic acid | Tetra-n-butyl polytitanate (n = 3) |
| 17 | Trimellitic acid | Titanium tetramethoxide |
| 18 | Trimellitic acid | Titanium tetra-n-propoxide |
| 19 | Trimellitic acid | Titanium tetra-n-butoxide |
| 20 | m-Oxybenzoic acid | Titanium tetramethoxide |
| 21 | m-Oxybenzoic acid | Titanium tetra-n-propoxide |
| 22 | m-Oxybenzoic acid | Titanium tetra-n-butoxide |
| 23 | p-Oxybenzoic acid | Titanium tetramethoxide |
| 24 | p-Oxybenzoic acid | Titanium tetra-n-propoxide |
| 25 | p-Oxybenzoic acid | Titanium tetra-n-butoxide |

The resin having polyester units to be used in the present invention preferably has a molecular weight main peak falling within a range from 3,500 to 15,000 in a molecular weight distribution measured by means of gel permeation chromatography (GPC). The main peak falls more preferably within a range from 4,000 to 13,000. In the above molecular weight distribution, the ratio between the weight average molecular weight (Mw) and the number average molecular weight (Mn), namely, the ratio Mw/Mn is preferably 3.0 or more, and more preferably 5.0 or more. When the main peak is found in a molecular weight range of less than 3,500, sometimes the high-temperature offset resistance of the toner is degraded. On the other hand, when the main peak is found in a molecular weight range of more than 15,000, sometimes a sufficient low-temperature fixing property of the toner and a sufficient transparency of an OHP sheet are not obtained. When the ratio Mw/Mn is less than 3.0, sometimes the anti-offset property is degraded.

The glass transition temperature (Tg) of the resin having polyester units used in the present invention preferably falls within a range from 40 to 90° C., and the softening temperature (Tm) thereof preferably falls 80 to 150° C. for the purpose of simultaneously attaining the storage stability, low-temperature fixing property, high-temperature offset resistance, and dispersibilty of the colorant. The acid value of the resin concerned is preferably less than 50 mg KOH/g from the viewpoint of improving the development stability in long-term and the dispersibility of the colorant.

The toner of the present invention may include binder resins well known in the art and used in conventional toners, in addition to the above resin having polyester units.

The toner of the present invention is characterized by including a wax therein.

In the present invention, by simultaneously using a wax and the resin having polyester units which is synthesized by use of an aromatic carboxylic acid titanium compound as a catalyst, the color reproducibility on the transfer material can be improved, and there can be thereby obtained an image in which the brightness and the chroma thereof are high, in particular, without degrading the transparency of an OHP image. Both of the low-temperature fixing property and the anti-offset property of the toner can also be simultaneously attained. This is understood to be ascribable to the dispersibility of the wax in the toner improved by the titanium, originated from the aromatic carboxylic acid titanium compound and dispersed uniformly in the resin so as to serve as a nucleating agent for the wax, when the wax is dispersed in the toner particles by melt-kneading or the like, in the presence of the resin having polyester units which is synthesized by use of the aromatic carboxylic acid titanium compound as a catalyst. Consequently the microdispersion of the wax is established in the toner particles, and there can be obtained such an image that the brightness and the chroma thereof are high without degrading the transparency of an OHP image.

Because the wax can be dispersed in the toner particles almost uniformly, the stability in long-term of the chargeability becomes excellent and an image maintaining a high image quality can be attained. A high transfer efficiency can also be attained in a step for transferring the toner developed on the photosensitive member to a transfer material such as paper or a transfer drum and a step for transferring the toner from the transfer belt to paper.

In addition to the uniform dispersion of the wax in the toner particles, the microdispersion within the toner particles is also established, and consequently the amount of the wax on the surface of the toner particles can be reduced and the charge stability of the toner can thereby be attained.

Examples of the wax used in the present invention may include: aliphatic hydrocarbon waxes, such as low-molecular weight polyethylene, low-molecular weight polypropylene, alkylene copolymer, microcrystalline wax, paraffin wax, and Fischer-Tropsch wax; oxides of aliphatic hydrocarbon waxes, such as polyethylene oxide wax, or block copolymers thereof; waxes composed chiefly of a fatty acid ester, such as carnauba wax, behenyl behenate wax and montanate wax, and those obtained by subjecting part or the whole of fatty acid esters to deacidification, such as acid-free carnauba wax. The examples may further include: saturated straight-chain fatty acids, such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol; polyhydric alcohols such as sorbitol; esters obtained from fatty acids such as palmitic acid, stearic acid, behenic acid and montanic acid and alcohols such as stearyl alcohol, aralkyl alcohol, behenyl alcohol, carnaubyl alcohol, ceryl alcohol and melissyl alcohol; fatty acid amides such as linoleic acid amide, oleic acid amide and lauric acid amide; saturated fatty acid bisamides such as methylene bis-stearic acid amide, ethylene bis-capric acid amide, ethylene bis-lauric acid amide and hexamethylene bis-stearic acid amide; unsaturated fatty acid amides such as ethylene bis-oleic acid amide, hexamethylene bis-oleic acid amide, N,N'-dioleyladipic acid amide and N,N'-dioleylsebasic acid amide; aromatic bisamides such as m-xylene bis-stearic acid amide and N,N'-distearylisophthalic acid amide; fatty acid metal salts (generally referred to as metal soaps) such as calcium stearate, calcium laurate, zinc stearate and magnesium stearate; waxes obtained as aliphatic hydrocarbon waxes grafted by use of vinyl monomers such as styrene and acrylic acid; partially esterified products of polyhydric alcohols with fatty acids, such as monoglyceride behenate; and methyl ester compounds having a hydroxyl group, obtained by hydrogenation of vegetable fats and oils.

Examples of the waxes particularly preferably used in the present invention may include aliphatic hydrocarbon waxes and esterified compounds as esters formed by reactions between fatty acids and alcohols. More specifically, preferable are low molecular weight alkylene polymers obtained by radical polymerization of alkylenes under a high pressure or obtained by polymerization of alkylenes under a low pressure in the presence of a Ziegler catalyst or a metallocene catalyst; alkylene polymers obtained by thermally decomposing high molecular weight alkylene polymers; and a synthetic hydrocarbon wax obtained from a distillation residue of a hydrocarbon obtained from a synthetic gas containing carbon monoxide and hydrogen on the basis of the Arge porcess, or a synthetic hydrocarbon wax obtained by hydrogenation thereof. A hydrocarbon wax having been subjected to fractionation based on the press-sweating method, the solvent processing method, vacuum distillation, or fractional crystallization is also more preferably used. As the source of the hydrocarbon wax, the following hydrocarbons are preferable because they are saturated long-linear-chain hydrocarbons with little branching: hydrocarbons (for example, hydrocarbon compounds synthesized by the Synthol process or the Hydrocol process (using a fluidized catalysts bed)) synthesized from carbon monoxide and hydrogen in the presence of a metal oxide catalyst (in many cases, of binary or multiple components); hydrocarbons having up to a few hundred carbon atoms synthesized by the Arge process (using a fixed catalyst bed) which can yield a product rich in waxy hydrocarbon; and hydrocarbons obtained by polymerizing an alkylene such as ethylene in the presence of a Ziegler catalyst. Waxes synthesized by the methods which do not invoke the polymerization of alkylenes are particularly preferable from the viewpoint of the molecular weight distributions thereof. Paraffin wax is also preferably used.

As for each of the waxes used in the present invention, in an endothermic curve thereof in differential scanning calorimetry (DSC), a temperature at which a maximum endothermic peak is exhibited in a temperature range from 30° C. to 200° C. preferably falls within a range from 60° C. to 130° C., more preferably within a range from 65 to 125° C., and furthermore preferably within a range from 65 to 110° C.

When the maximum endothermic peak temperature of a wax falls within the range from 60 to 130° C., an appropriate microdispersion of the wax can be attained in the toner particles preferably for the purpose of attaining the advantageous effect of the present invention. On the other hand, when the maximum endothermic peak temperature falls within a range of lower than 60° C., the anti-blocking property of the toner is degraded, whereas when the maximum endothermic peak temperature falls within a range of higher than 130° C., the fixing property of the toner tends to be degraded.

The toner of the present invention has the transmittance thereof in an aqueous solution of 45% by volume of methanol which falls preferably within a range from 10 to 70%, more preferably within a range from 10 to 60%, and furthermore preferably within a range from 15 to 50%.

The toner of the present invention contains a wax in the toner particles, and accordingly at least the wax is present on the surface of the toner particles. When the amount of the wax on the surface of the toner particles is too small, the releasing effect is hardly exhibited at the time of fixing, and consequently the effect of the low temperature fixing property desirable from the viewpoint of energy saving is reduced. On the other hand, the amount of the wax present on the surface of the toner particles is too large, the charging member is stained with the toner. In this case, for example, the toner is melt-adhered onto the developing sleeve to make the sleeve higher in electric resistance, and consequently the effect of the development bias actually applied to the developing sleeve is lowered, eventually degrading the image density and impairing the development durability as the case may be. Thus, it is important to control the amount of the wax on the surface of the toner particles when the wax is contained in the toner.

Accordingly, the present invention uses a resin having polyester units which is synthesized by use of an aromatic carboxylic acid titanium compound as a catalyst simultaneously with a wax, and it is thereby made possible that microdispersion of the wax in the toner particles can be achieved and the amount of the wax on the surface of the toner particles can be appropriately controlled even when the amount of the wax added to the toner is large.

It may be noted that the above described transmittance (%) of the toner in an aqueous solution of 45% by volume of methanol is used as an indicator with which the amount of wax on the surface of the toner particles can be measured simply and highly accurately.

In the measurement method of the above described transmittance, the toner particles are once compulsorily dispersed in a methanol-water mixed solvent so that the surface wax amounts on the individual toner particles may be easily characterized, and then the transmittance is measured after a certain elapsed time, so that the amount of the wax on the surface of the toner particles can be accurately found.

More specifically, when the hydrophobic wax is present on the surface of the toner particles in a large amount, the dispersed toner hardly gets wet with the solvent and settles out to increase the transmittance. On the contrary, when the amount of the wax on the surface of the toner particles is small, the transmittance is decreased because the resin used in the present invention has a large content of the polyester unit and thereby has a strong polarity, so that the toner is hydrophilic and dispersed almost uniformly in the mixed solvent.

As for the toner of the present invention, in an endothermic curve thereof obtained by differential scanning calorimetry (DSC) analysis, a temperature at which a maximum endothermic peak is exhibited in a temperature range from 30° C. to 200° C. preferably falls within a range from 60° C. to 130° C., more preferably within a range from 65° C. to 125° C., and furthermore preferably within a range from 65° C. to 110° C. By including in the toner an appropriately selected wax which in an endothermic curve thereof in DSC measurement, exhibits a temperature, at which a maximum endothermic peak is exhibited in a temperature range from 30° C. to 200° C., falling within a range from 60° C. to 130° C., there can be obtained the toner of the present invention which has a maximum endothermic peak, in the temperature range from 30 to 200° C., falling within the above described ranges.

In the case where the resin of the present invention having the polyester units which is synthesized by use of an aromatic carboxylic acid titanium compound as a catalyst is used, when the maximum endothermic peak temperature of the toner falls within the range from 60 to 130° C., an appropriate microdispersion of the wax in the toner particles can be attained preferably for the purpose of achieving the advantageous effect of the present invention. On the other hand, when the maximum endothermic peak temperature falls within a range of lower than 60° C., the anti-blocking property of the toner is degraded, whereas when the maximum endothermic peak temperature falls within a range of higher than 130° C., the fixing property of the toner tends to be degraded.

It is recommended that the wax is used in a content of 0.1 to 20 parts by mass in relation to 100 parts by mass of the binder resin, and preferably 0.5 to 10 parts by mass.

As for the toner of the present invention, the resin component thereof preferably has a molecular weight main peak falling within a range from 3,500 to 15,000 in a molecular weight distribution measured by means of gel permeation chromatography (GPC). The molecular weight main peak falls more preferably within a range from 4,000 to 13,000. In the above molecular weight distribution, the ratio Mw/Mn is preferably 3.0 or more, and more preferably 5.0 or more. When the molecular weight main peak is found in a range of less than 3,500, sometimes the high-temperature offset resistance of the toner is degraded. On the other hand, when the molecular weight main peak is found in a range of more than 15,000, sometimes a sufficient low-temperature fixing property of the toner and a sufficient transparency of an OHP sheet are not obtained. When the ratio Mw/Mn is less than 3.0, sometimes a satisfactory anti-offset property is degraded. By including in the toner an appropriately selected binder resin which has such a molecular weight distribution as described above, there can be obtained the toner of the present invention which has a desired molecular weight distribution.

The toner of the present invention further includes a colorant. As the colorant used for the toner of the present invention, dyes and/or pigments well known in the art may be used. Such a pigment may be used alone, but from the viewpoint of image quality of full-color images, it is more preferable to use a dye and a pigment in combination to improve sharpness of the images.

Examples of the coloring pigments for magenta toner may include: condensed azo compounds, diketopyrrolopyrrole compounds, anthraquinones, quinacridone, basic dye lake compounds, naphthol compounds, benzimidazolone compounds, thioindigo compounds and perylene compounds. Specific examples concerned may include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 144, 146, 150, 163, 166, 169, 177, 184, 185, 2.02, 206, 207, 209, 220, 221, 254; C.I. Pigment Violet 19; and C.I. Vat Red 1, 2, 10, 13, 15, 23, 29, 35.

Examples of the dyes for magenta toner may include: oil-soluble dyes such as C.I. Solvent Red 1, 3, 8, 23, 24, 25, 27, 30, 49, 81, 82, 83, 84, 100, 109, 121, C.I. Disperse Red 9, C.I. Solvent Violet 8, 13, 14, 21, 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, 40, and C.I. Basic Violet 1, 3, 7, 10, 14, 15, 21, 25, 26, 27, 28.

Examples of the coloring pigments for cyan toner may include: C.I. Pigment Blue 1, 2, 3, 7, 15:2, 15:3, 15:4, 16, 17, 60, 62, 66; C.I. Vat Blue 6, and C.I. Acid Blue 45, and copper phthalocyanine pigments in which the phthalocyanine skeleton having a structure shown in the following formula has been substituted with 1 to 5 phthalimide methyl group(s):

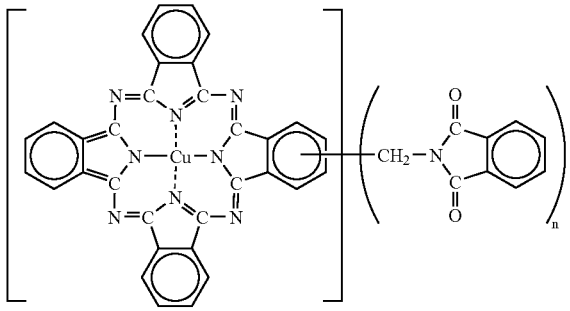

wherein n represents an integer of 1 to 5.

Examples of the coloring pigments for yellow toner may include: condensed azo compounds, isoindolinone compounds, anthraquinone compounds, azo metal compounds, methine compounds and arylamide compounds. Specific examples of the pigments concerned may include: C.I. Pigment Yellow 1, 2, 3, 4, 5, 6, 7, 10, 11, 12, 13, 14, 15, 16, 17, 23, 62, 65, 73, 74, 83, 93, 95, 97, 109, 110, 111, 120, 127, 128, 129, 147, 155, 168, 174, 180, 181, 185, 191; and C. I. Vat Yellow 1, 3, 20. The following dyes may also be used: C. I. Direct Green 6, C. I. Basic Green 4, C. I. Basic Green 6, and Solvent Yellow 162.

As black colorants used in the present invention, usable are carbon black, iron oxides, and colorants toned in black by use of the above described yellow, magenta and cyan colorants.

In the present invention, it is also preferable to use master batches in each of which a colorant is mixed in the binder resin in advance. By melt-kneading each of the colorant master batches and other raw materials (other binder resins, waxes and the like), the colorant concerned can be dispersed in the toner satisfactorily.

When each of the colorants is made to take a form of a master batch by use of the resin having the above polyester units of the present invention, even in the case where large amounts of colorants are used, the dispersibility of each of the colorants is not degraded in the master batch concerned, and dispersibility of each of the colorants in the toner particles can be improved, so that there can be obtained a toner excellent in the color reproducibility including color mixing property and transparency. There can also be obtained a toner having a large covering power on the transfer material. Since the dispersibility of each of the colorants is improved, the stability in long-term of the chargeability of the toner is made excellent and accordingly there can be obtained an image maintaining a high image quality.

Each of the colorants may be used in a content of preferably from 0.1 to 15 parts by mass, and more preferably from 0.5 to 12 parts by mass, and particularly preferably from 2 to 10 parts by mass in relation to 100 parts by mass of the binder resin, from the viewpoint of the color reproducibility and developability of the toner.

To the toner of the present invention, a charge control agent well known in the art may be applied for the purpose of stabilizing the chargeability of the toner. The charge control agent may be generally contained in the toner particles in a content of preferably from 0.1 to 10 parts by mass, and more preferably from 0.1 to 5 parts by mass in relation to 100 parts by mass of the binder resin, although the content of the charge control agent is varied depending on the type of the charge control agent and the physical properties of the materials constituting the toner particles. As such charge control agents, some charge control agents are known to control the toner to exhibit negative chargeability and other charge control agents are known to control the toner to exhibit positive chargeability; there may be used one or more charge control agents selected from various charge control agents according to the types and the application purposes of the toners.

As the charge control agents for negative chargeability, there may be used salicylic acid metal compounds, naphthoic acid metal compounds, dicarboxylic acid metal compounds, polymer compounds having as side chains thereof sulfonic acids or carboxylic acids, boron compounds, urea compounds, silicon compounds, calixarenes and the like. As the charge control agents for positive chargeability, there may be used quaternary ammonium salts, polymer compounds having as side chains thereof the quaternary ammonium salts, guanidine compounds, imidazole compounds and the like. The charge control agents may be added to the toner particles either internally or externally. Because the toner of the present invention is used for the formation of full-color images, it is preferable to use aromatic carboxylic acid metal compounds which are colorless, give fast speed of charging to the toners, and can stably maintain certain charge quantities.

The toner of the present invention is characterized in that inorganic fine particles containing at least fine titanium oxide particles are externally added thereto. For the fine titanium oxide particles used in the present invention, preferably used are fine titanium oxide particles obtained by a sulfuric acid method, a chlorine method, or low-temperature oxidation (thermal decomposition or hydrolysis) of volatile titanium compounds (for example, titanium alkoxides, titanium halides, and titanium acetylacetonate). As the crystal system of fine titanium oxide particles, there can be used any of anatase, rutile, a mixed crystal composed of anatase and rutile, and amorphous systems.

The present inventors have found that the external addition of fine titanium oxide particles to the toner particles containing a resin having polyester units, which is synthesized by use of an aromatic carboxylic acid titanium compound as a catalyst, is extremely effective for the charge stabilization in long-term service, in particular, for the charge stabilization in a low-humidity environment. The reason for this is such that, when the resin having polyester units, which is synthesized by use of the aromatic carboxylic acid titanium compound as a catalyst, is contained in the toner together with fine titanium oxide particles, the fine titanium oxide particles exhibit an almost neutral chargeability and a charge-up suppression effect is thereby attained particularly in a low-humidity environment.

From the viewpoint of the control of the charge quantity, it is preferable to further, externally add fine silica particles to the toner of the present invention. As the fine silica particles preferably usable for the toner of the present invention, there can be used both of so-called dry-process silica, referred to as silica based on a dry process or fumed silica, produced by the vapor phase oxidation of a silicon halide and so-called wet-process silica produced from water glass or the like; however, dry-process silica is preferable because, in dry-process silica, the silanol groups present on the surface and in the interior of the silica fine powder are small in quantity, and the production residues such as $Na_2O$ and $SO_3^-$ are also small in quantity. As for dry-process silica, a composite fine powder composed of silica and another metal oxide can be obtained by using another metal halide such as aluminum chloride or titanium chloride together with a silicon halide in the course of the production thereof, and such a composite fine powder is also one form of the silica fine powder according to the present invention.

The so-called dry-process silica or fumed silica is produced by the technique well known in the art. Such a technique is, for example, a technique which utilizes the thermal decomposition oxidation of a silicon tetrachloride gas in oxyhydrogen flame and the process involved is based on the reaction expressed by the following formula:

$$SiCl_4+2H_2+O_2 \rightarrow SiO_2+4HCl$$

It is also preferable that the fine titanium oxide particles and the fine silica particles are made hydrophobic by use of hydrophobizing agents such as a silane compound, a silicone oil, or a mixture thereof. Examples of such a hydrophobizing agent may include coupling agents such as a silane compound, a titanate coupling agent, an aluminum coupling agent and a zirco-aluminate coupling agent.

More specifically, as a silane compound, the compound expressed by the following general formula is preferable:

$$R_mSiY_n$$

wherein R represents an alkoxy group and m represents an integer of 1 to 3; and Y represents an alkyl group, a vinyl group, a phenyl group, a methacrylic group, an amino group, an epoxy group, a mercapto group or a derivative of any of these groups, and n represents an integer of 1 to 3.

Examples of the silane compound represented by the above general formula may include: hexamethyldisilazane, vinyltrimethoxysilane, vinyltriethoxysilane, γ-methacryloxypropyltrimethoxysilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane and n-octadecyltrimethoxysilane. In the hydrophobizing treatment, each of the silane compounds may preferably be used in a content of 1 to 60 parts by mass, and more preferably 3 to 50 parts by mass, in relation to 100 parts by mass of the inorganic fine particles.

In the present invention, particularly preferable is an alkylalkoxysilane compound represented by the following general formula:

$$C_nH_{2n+1}—Si—(OC_mH_{2m+1})_3$$

wherein n represents an integer of 1 to 12, and m represents an integer of 1 to 3.

In the alkylalkoxysilane compound, when n is larger than 12, although hydrophobicity comes to be sufficient, inorganic fine particles may largely coalesce one another to tend to have a low fluidity-providing ability. When m is larger than 3, the alkylalkoxysilane compound may have a low reactivity to make it hard to hydrophobize the inorganic fine particles in a satisfactory manner. More preferable are the alkylalkoxysilane compounds for which n is 1 to 8, and m is 1 or 2 in the above general formula.

In the treatment with the alkylalkoxysilane compound, the alkylalkoxysilane compound may be used in a content of 1 to 60 parts by mass, and preferably 3 to 50 parts by mass, in relation to 100 parts by mass of the inorganic fine particles.

The hydrophobizing treatment may be made by use of one hydrophobizing agent alone or two or more hydrophobizing agents in combination. More specifically, the hydrophobizing treatment may be made by use of one hydrophobizing agent alone; or the hydrophobizing treatment may be made by use of two hydrophobizing agents simultaneously or one hydrophobizing agent, and thereafter a further hydrophobizing treatment may be made by use of another hydrophobizing agent.

The fine titanium oxide particles and/or the fine silica particles may be added preferably in a content of 0.01 to 5 parts by mass, and more preferably 0.05 to 3 parts by mass, in relation to 100 parts by mass of the toner particles.

The weight average particle diameter (D4) of the toner according to the present invention is preferably 3.0 to 11.0 μm, and more preferably 4.0 to 8.5 μm. When the weight average particle diameter concerned falls within these ranges, highly fine images tend to be easily obtained.

The toner of the present invention may be used as a one-component developer and also as a two-component developer. In the case where the toner is used as a two-component developer, the toner is used as a mixture with a magnetic carrier. As the magnetic carrier, usable are well known magnetic carriers such as magnetic particles themselves, a coated carrier in which magnetic particles are coated with a resin, a magnetic substance dispersed resin carriers in which magnetic particles are dispersed in resin particles and the like. As the magnetic particles, usable are, for example, surface-oxidized or surface-nonoxidized particles of metals such as iron, lithium, calcium, magnesium, nickel, copper, zinc, cobalt, manganese, chromium and rare earth elements, and particles of alloys of these metals, particles of oxides of these metals, and particles of ferrites containing any of these elements.

The coated carrier in which the surface of the magnetic particles is coated with a resin is particularly preferable in a development method in which an alternating current bias is applied to the developing sleeve. As coating methods, applicable are conventionally known methods such as a method in which a coating fluid prepared by dissolving or suspending a coating material such as a resin in a solvent is made to adhere onto the surface of the magnetic particles, and a method in which the magnetic particles and a coating material are mixed as powders.

Examples of the coating material for the surface of the magnetic particles in the above coated carrier may include: silicone resin, polyester resin, styrene resin, acrylic resin, polyamide, polyvinylbutyral, aminoacrylate resin and fluorocarbon resin. These are used each alone or in combinations of two or more thereof. In the coating treatment, each of these coating materials may be used preferably in a content of 0.1 to 30% by mass (more preferably 0.5 to 20% by mass), in relation to the magnetic particles. These magnetic particles may have a number average particle diameter of 10 to 100 am, and more preferably 20 to 70 μm.

As for the number average particle diameter of the magnetic particles, the number average particle diameter of the carrier is derived as follows: from an image of the carrier obtained by a scanning electron microscope (at a magnification of 100 to 5000), 300 or more carrier particles of 0.1 μm or more in particle diameter are sampled at random, the horizontal Feret's diameters of the sampled particles are measured as the carrier particle diameters by means of a digitizer, and the number average particle diameter concerned is derived therefrom.

In the case where a two-component developer is prepared by blending the toner and the magnetic carrier of the present invention, satisfactory results can usually be obtained when the blending proportion thereof is such that the toner concentration in the developer is set at 2 to 15% by mass, and preferably 4 to 13% by mass. When the toner concentration is less than 2% by mass, the image density tends to be lowered, while when the toner concentration exceeds 15% by mass, fog and toner scatter within the machine tend to occur.

Next, a procedure for producing the toner of the present invention will be described below. The toner of the present invention can be produced as follows: a mixture composed of a binder resin, a colorant, a wax and other optional materials is melt-kneaded, the kneaded mixture is cooled and pulverized, the pulverized product is subjected to the spheroidization treatment and the classification treatment according to need, and the thus treated product is mixed with inorganic fine particles including fine titanium oxide particles and further according to need including fine silica particles, to yield the toner.

First, in the step of mixing the starting materials, at least a resin and a colorant, as the internal additives to the toner particles, are weighed in predetermined quantities to be blended and are mixed together. Examples of the mixer may include: a double cone mixer, a V-type mixer, a drum type mixer, a Super mixer, a Henschel mixer and a Nauta mixer.

Then, the toner starting materials blended and mixed in the above step are melt-kneaded to melt the resins, and the colorant and the like are dispersed in the melt-kneaded product. In the melt-kneading step, for example, batch type kneaders such as a pressure kneader and Banbury mixer, or continuous-type kneaders may be used. In these years, single-screw or twin-screw extruders are dominantly used owing to an advantage thereof permitting continuous production. Among commonly used extruders are a KTK-type twin-screw extruder manufactured by Kobe Steel, Ltd., a TEM-type twin-screw extruder manufactured by Toshiba Machine Co., Ltd., a twin-screw extruder manufactured by KCK Co., and a co-kneader manufactured by Coperion Buss Ag. The colored resin composition obtained by melt-kneading the toner starting materials is, after melt-kneading, subjected to rolling with a twin-roll or the like, and then cooled through a cooling step where the composition is cooled with water or the like.

In general, the cooled product of the colored resin composition obtained in the above is then pulverized to a desired particle diameter in a pulverizing step. In the pulverizing step, the cooled product is first crushed with a crusher, a hammer mill, a feather mill or the like, and is further pulverized with Criptron system manufactured by Kawasaki Heavy Industries, Ltd., Super rotor manufactured by Nisshin Engineering Inc. or the like. Thereafter, according to need, the pulverized product is classified by use of a screening machine including a classifier such as Elbow Jet (manufactured by Nittetsu Mining Co., Ltd.) based on inertial classification or Turboplex (manufactured by Hosokawa Micron Corp.) based on centrifugal classification, to yield a classified fraction having a weight average particle diameter (D4) of 3 to 11 μm.

The obtained classified fraction may be subjected to a surface modification treatment and a spheroidization treatment, according to need, by means of, for example, a hybridization system manufactured by Nara Machinery Co., Ltd. or a mechanofusion system manufactured by Hosokawa Micron Corporation. In such a case, according to need, a screening machine such as High Bolter (manufactured by Shintokyo Kikai Co., Ltd.) based on wind screening may be used. In this way, the toner particles constituting the toner of the present invention are obtained. The toner of the present invention is also obtained by externally adding an external additive such as inorganic fine particles to the above toner particles. Examples of the treatment method for external addition of an external additive to the toner particles may include a method in which a classified toner and well known various external additives are blended in predetermined contents, and are agitated and mixed together by using as a device for external addition a high speed agitator which exerts a shear force to a powder such as Henschel mixer and Super mixer.

The methods for measuring the physical property values of the toner in the present invention are as follows.

1) The Transmittance in an Aqueous Solution of 45% by Volume of Methanol (i) Preparation of a Liquid Toner Dispersion An aqueous solution is prepared in which the volume ratio of methanol to water is 45:55. Then, 10 ml of this aqueous solution is placed in a 30 ml sample bottle (SV-30, available from Nichiden-Rika Glass Co., Ltd.), and 20 mg of the toner is immersed in the aqueous solution in the vicinity of the surface of the solution, and then the bottle is closed with a lid. Thereafter, the sample bottle is shaken at a frequency of 2.5 $s^{-1}$ for 5 seconds by use of Yayoi shaker (model: YS-LD). In this case, the angle of shaking is set in such a way that the shaking pole moves forward by 15 degrees and backward by 20 degrees with an angle of 0 degree assumed for the direction arrow pointing directly above the shaker (the vertical direction). The sample bottle is fixed to a fixing holder attached to the top end of the pole (the lid of the sample bottle is fixed at a position located along an extension of the axis of the pole). The sample bottle is unfixed, and a liquid dispersion after 30 seconds from the unfixing is used as a liquid dispersion for measurement.

(ii) Measurement of Transmittance

The liquid dispersion obtained in (i) is placed in a 1 cm square quartz cell, and after 10 minutes, the transmittance (%) at a wavelength of 600 nm of the liquid dispersion is measured on a spectrophotometer MPS2000 (manufactured by Shimadzu Corp.). The transmittance (%) concerned is represented by the following formula:

$$\text{Transmittance (\%)}=(I/I_0)\times 100$$

wherein I represents the transmitted light intensity and $I_0$ represents the incident light intensity.

2) Measurement of the Maximum Endothermic Peak Temperature of the Toner and Wax

Temperature Curve:

Heating I (30° C. to 200° C.; heating rate: 10° C./min)
Cooling I (200° C. to 30° C.; cooling rate: 10° C./min)
Heating II (30° C. to 200° C.; heating rate: 10° C./min)

The maximum endothermic peaks of the toner and wax can be measured by use of a differential scanning calorimeter (DSC instrument) DSC-7 (manufactured by PerkinElmer, Inc.) or DSC2920 (manufactured by TA Instruments Japan Ltd.). The measurement method is in conformity with ASTM D3418-82.

A sample for measurement is accurately weighed in an amount of 5 to 20 mg, preferably 10 mg. The sample is placed on an aluminum pan, an empty aluminum pan being used as reference. Measurement is made under normal temperature and humidity at a heating rate of 10° C./min within a measurement temperature range from 30 to 200° C. The maximum endothermic peak of the toner or the wax is a peak which is highest as measured in the process of Heating II from the base line in the region above the endothermic peak at Tg of the resin, or, when other endothermic peaks overlap with the endothermic peak at Tg of the resin in a hardly identifiable manner, the highest peak of the overlapping peaks is taken as the maximum endothermic peak.

3) Molecular Weight Distribution Based on the GPC Measurement

The molecular weight of the binder resin is measured on the basis of a chromatogram of gel permeation chromatography (GPC) under the following conditions.

A column is stabilized in a heat chamber at 40° C. Through the column maintained at this temperature, tetrahydrofuran (THF) as a solvent is made to flow at a flow rate of 1 ml per minute, and about 50 to 200 μl of a sample THF solution of the resin controlled to a sample concentration of 0.05 to 0.6% by mass is injected for measurement. In measuring the molecular weight of the sample, the molecular weight distribution of the sample is derived on the basis of a calibration curve, prepared from several types of monodispersed polystyrene standard samples, giving a relationship between the logarithmic value of the molecular weight and the count number (retention time). As the standard polystyrene samples for preparation of the calibration curve, for example, those available from Tosoh Corp. or Pressure Chemical Co., having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ may be employed, and it is appropriate to use at least about 10 different standard polystyrene samples. As the detector, an RI (refractive index) detector is used.

As for the column, for the purpose of making accurate measurement in the molecular weight range from $10^3$ to $2\times10^6$, it is preferable to use a combination of a plurality of commercially available polystyrene gel columns. Examples of such a combination may include a combination of Shodex GPC KF-801, 802, 803, 804, 805, 806 and 807, available from Showa Denko K.K., and a combination of μ-Styragel 500, $10^3$, $10^4$ and $10^5$, available from Waters Co.

4) Measurement of the Particle Size Distribution of the Toner

In the present invention, the average particle diameter and the particle size distribution of the toner are measured with a Coulter counter Model TA-II (manufactured by Coulter Electronics, Inc.). Coulter Multisizer (manufactured by Coulter Electronics, Inc.) may also be used. As an electrolytic solution, a 1% aqueous NaCl solution is prepared using extra-pure-grade sodium chloride. For example, ISOTON R-II (available from Coulter Scientific Japan Co.) may be used. For measurement, 0.1 to 5 ml of a surfactant, preferably an alkylbenzenesulfonate, is added as a dispersant to 100 to 150 ml of the above electrolytic solution, and further 2 to 20 mg of a sample for measurement is added thereto. The electrolytic solution in which the sample is suspended is subjected to a dispersion treatment for about 1 to 3 minutes with an ultrasonic disperser. The volume distribution and the number distribution of the toner are derived by measuring the volume and number of the toner particles of 2.00 μm or more in diameter by use of the above instrument, adopting a 100 μm aperture. Then, the weight average particle diameter (D4) (the median of each channel is adopted as the representative value for each channel) according to the present invention are determined.

As channels, the following 13 channels are used: 2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32.00 to 40.30 μm.

5) Measurement of the Acid Value of the Resin

Basic operations are in conformity with JIS K-0070.

(1) A crushed product of a sample is accurately weighed in an amount of 0.5 to 2.0 g, the mass of the sample being represented by W (g).

(2) The sample is placed in a 300 ml beaker, and 150 ml of a toluene/ethanol (4/1) mixed solvent is added thereto to dissolve the sample.

(3) By use of a 0.1 mol/l KOH ethanol solution, titration is made by means of a potentiometric titrator. (For example, automatic titration is applicable where a potentiometric titrator AT-400 (Win Workstation), and an ABP-410 motor burette, manufactured by Kyoto Electronics Manufacturing Co., Ltd. may be used.)

(4) The amount of the KOH solution used in the above titration is represented by S (ml). A blank measurement is also made to determine the amount of the KOH solution used in the blank measurement, which is represented by B (ml).

(5) The acid value is derived according to the following formula, wherein f denotes the factor for KOH:

$$\text{Acid value (mg KOH/g)}=((S-B)\times f\times 5.61)/W$$

6) Measurement of the Glass Transition Temperature of the Resin

The glass transition temperature (Tg) of the resin is measured in conformity with ASTM D3418-82, by use of a differential scanning calorimeter (DSC instrument) DSC-7 (manufactured by PerkinElmer, Inc.) or DSC2920 (manufactured by TA Instruments Japan Ltd.).

A sample for measurement is accurately weighed in an amount of 5 to 20 mg, and preferably 10 mg. This sample is placed on an aluminum pan, an empty aluminum pan being used as reference. Measurement is made under normal temperature and humidity at a heating rate of 10° C./min within a measurement temperature range from 30° C. to 200° C. In the course of this heating, a specific heat change is observed within a temperature range from 40° C. to 100° C. The intersection between a line passing through the middle-point of the base line segment ranging from the start point and the end point of the specific heat change and the differential thermal curve is taken as the glass transition point Tg of the resin of the present invention.

7) Measurement Method of the Softening Point of the Resin

The softening point as referred to here means a value as measured in conformity with JIS K 7210 by use of a Koka type flow tester. The measurement method adopted is specifically described below. By use of a Koka type flow tester (manufactured by Shimadzu Corp.), while 1 $cm^3$ of a sample is being heated at a heating rate of 6° C./min, a load of 1960 $N/m^2$ (20 $kg/cm^2$) is applied by means of a plunger to extrude the sample through a nozzle of 1 mm in diameter and 1 mm in length, where a plunger fall distance (flow value)-temperature curve is drawn. When the height of S-shaped curve is denoted by h, the temperature corresponding to h/2 (the temperature at which a half of the resin has been flowed out) is taken as the softening point (Tm) of the resin.

EXAMPLES

Specific examples of the present invention will be described below, but the present invention is not limited to these examples.

Production Example 1 of the Aromatic Carboxylic Acid Titanium Compound

In a 4-liter four-necked glass flask equipped with a thermometer, a stirring rod, a condenser and a nitrogen inlet tube and placed in a mantle heater, 66.4 parts by mass of isophthalic acid and 20 parts by mass of ethylene glycol were placed and mixed together, and melted at 100° C., and then dehydrated under reduced pressure. Then, the reaction mixture was cooled down to 50° C., and subsequently, 17.2 parts by mass of titanium tetramethoxide was added thereto in an atmosphere of nitrogen. Thereafter, under reduced pressure, the methanol as a reaction product was distilled off, and the reaction was allowed to proceed to yield aromatic carboxylic acid titanium compound 1.

Production Example 2 of the Aromatic Carboxylic Acid Titanium Compound

There was adopted the same manner as in the production example 1 of the aromatic carboxylic acid titanium compound, except that 17.2 parts by mass of titanium tetramethoxide was replaced with 34.0 parts by mass of titanium tetra-n-butoxide. The produced butanol was distilled off, and the reaction was allowed to proceed to yield aromatic carboxylic acid titanium compound 2.

Production Example 3 of the Aromatic Carboxylic Acid Titanium Compound

Aromatic carboxylic acid titanium compound 3 was obtained in the same manner as in the production example 1 of the aromatic carboxylic acid titanium compound, except that isophthalic acid was replaced with terephthalic acid.

Production Example 4 of the Aromatic Carboxylic Acid Titanium Compound

Aromatic carboxylic acid titanium compound 4 was obtained in the same manner as in the production example 1 of the aromatic carboxylic acid titanium compound, except that 66.4 parts by mass of isophthalic acid was replaced with 166.6 parts by mass of terephthalic acid, 20 parts by mass of ethylene glycol was replaced with 10 parts by mass of ethylene glycol, and 17.2 parts by mass of titanium tetramethoxide was replaced with 22.8 parts by mass of titanium tetraethoxide.

Production Example 5 of the Aromatic Carboxylic Acid Titanium Compound

There was adopted the same manner as in the production example 3 of the aromatic carboxylic acid titanium compound, except that 17.2 parts by mass of titanium tetramethoxide was replaced with 28.4 parts by mass of titanium tetra-n-propoxide. The produced propanol was distilled off, and the reaction was allowed to proceed to yield aromatic carboxylic acid titanium compound 5.

Production Example 6 of the Aromatic Carboxylic Acid Titanium Compound

There was adopted the same manner as in the production example 3 of the aromatic carboxylic acid titanium compound, except that 17.2 parts by mass of titanium tetramethoxide was replaced with 34.0 parts by mass of titanium tetra-n-butoxide. The produced butanol was distilled off, and the reaction was allowed to proceed to yield aromatic carboxylic acid titanium compound 6.

Production Example 7 of the Aromatic Carboxylic Acid Titanium Compound

There was adopted the same manner as in the production example 3 of the aromatic carboxylic acid titanium compound, except that 20 parts by mass of ethylene glycol was replaced with 40 parts by mass of ethylene glycol, 17.2 parts by mass of titanium tetramethoxide was replaced with 75.9 parts by mass of tetra-n-butyl polytitanate. The produced butanol was distilled off, and the reaction was allowed to proceed to yield aromatic carboxylic acid titanium compound 7.

Production Example 8 of the Aromatic Carboxylic Acid Titanium Compound

There was adopted the same manner as in the production example 1 of the aromatic carboxylic acid titanium compound, except that 66.4 parts by mass of isophthalic acid was replaced with 105.0 parts by mass of trimellitic acid, 20 parts by mass of ethylene glycol was replaced with 25 parts by mass of ethylene glycol, and 17.2 parts by mass of titanium tetramethoxide was replaced with 28.4 parts by mass of titanium tetra-n-propoxide. The produced propanol was distilled off, and the reaction was allowed to proceed to yield aromatic carboxylic acid titanium compound 8.

Production Example 9 of the Aromatic Carboxylic Acid Titanium Compound

There was adopted the same manner as in the production example 1 of the aromatic carboxylic acid titanium compound, except that 66.4 parts by mass of isophthalic acid was replaced with 110.4 parts by mass of m-oxybenzoic acid, 20 parts by mass of ethylene glycol was replaced with 40 parts by mass of ethylene glycol, and 17.2 parts by mass of titanium tetramethoxide was replaced with 34.0 parts by mass of titanium tetra-n-butoxide. The produced butanol was distilled off, and the reaction was allowed to proceed to yield aromatic carboxylic acid titanium compound 9.

Production Example 10 of the Aromatic Carboxylic Acid Titanium Compound

There was adopted the same manner as in the production example 1 of the aromatic carboxylic acid titanium compound, except that 66.4 parts by mass of isophthalic acid was replaced with 69.0 parts by mass of p-oxybenzoic acid, 20 parts by mass of ethylene glycol was replaced with 30 parts by mass of ethylene glycol, and 17.2 parts by mass of titanium tetramethoxide was replaced with 28.4 parts by mass of titanium tetra-n-propoxide. The produced propanol was distilled off, and the reaction was allowed to proceed to yield aromatic carboxylic acid titanium compound 10.

Production Example 1 of the Aromatic Diol Titanium Compound

In a 4-liter four-necked glass flask equipped with a thermometer, a stirring rod, a condenser and a nitrogen inlet tube and placed in a mantle heater, 70.0 parts by mass of bisphenol A-ethylene oxide 2-mol adduct and 20 parts by mass of ethylene glycol were placed and mixed together, and melted at 100° C., and then dehydrated under reduced pressure. Then, the reaction mixture was cooled down to 50° C., and subsequently, 17.2 parts by mass of titanium tetramethoxide was added thereto in an atmosphere of nitrogen. Thereafter, under reduced pressure, the methanol as a reaction product was distilled off, and the reaction was allowed to proceed to yield aromatic diol titanium compound 1.

Production Example 1 of the Resin Having Polyester Units

As the components to produce the polyester unit, 5.2 mol of polyoxyethylene(2.2)-2,2-bis(4-hydroxyphenyl)propane, 1.8 mol of terephthalic acid, 2.5 mol of dodecenylsuccinic acid, 0.5 mol of trimellitic anhydride, 1.0 g of aromatic carboxylic acid titanium compound 3 as a catalyst and 0.1 g of potassium titanyl oxalate as a catalyst were placed in a 4-liter four-necked glass flask. The flask was equipped with a thermometer, a stirring rod, a condenser and a nitrogen inlet tube and placed in a mantle heater. The reaction mixture was allowed to react in an atmosphere of nitrogen, at 230° C., for 4 hours to yield Resin 1 having polyester units. The content of the polyester unit component in Resin 1 concerned was found to be 100% by mass. The physical properties of Resin 1 having polyester units are shown in Table 2.

(Production Example 2 of the Resin Having Polyester Units

As the components to produce the vinyl polymer unit, 1.1 mol of styrene, 0.14 mol of 2-ethylhexyl acrylate, 0.1 mol of acrylic acid and 0.05 mol of dicumyl peroxide were placed in a dropping funnel. Also, as the components to produce the polyester unit, 2.0 mol of polyoxypropylene(2.2)-2,2-bis(4-hydroxyphenyl)propane, 0.8 mol of polyoxyethylene(2.2)-2,2-bis(4-hydroxyphenyl)propane, 0.8 mol of terephthalic acid, 0.6 mol of trimellitic anhydride, 1.5 mol of fumaric acid, 1.5 g of aromatic carboxylic acid titanium compound 4 as a catalyst and 0.4 g of aromatic carboxylic acid titanium compound 1 as a catalyst were placed in a 4-liter four-necked glass flask. The flask was equipped with a thermometer, a stirring rod, a condenser and a nitrogen inlet tube and placed in a mantle heater. The air inside the flask was replaced with nitrogen gas. Then, the temperature of the reaction mixture in the flask was gradually increased under stirring. At a temperature of 150° C., from the aforementioned dropping funnel, the monomer, the cross-linking agent, and the polymerization initiator to produce the vinyl resin were dropped into the flask under stirring over a period of 4 hours. Then, the temperature of the reaction mixture was raised up to 230° C., and the reaction mixture was allowed to react at that temperature for 4 hours to yield Resin 2 having polyester units. The content of the polyester unit component in Resin 2 concerned was found to be 90% by mass. The physical properties of Resin 2 having polyester units are shown in Table 2.

Production Example 3 of the Resin Having Polyester Units

As the components to produce the polyester unit, 5.2 mol of polyoxypropylene(2.2)-2,2-bis(4-hydroxyphenyl)propane, 1.8 mol of terephthalic acid, 2.5 mol of dodecenylsuccinic acid, 0.5 mol of trimellitic anhydride, and 1.0 g of aromatic carboxylic acid titanium compound 3 as a catalyst were placed in a 4-liter four-necked glass flask. The flask was equipped with a thermometer, a stirring rod, a condenser and a nitrogen inlet tube and placed in a mantle heater. The reaction mixture was allowed to react in an atmosphere of nitrogen at 230° C. for 6 hours to yield Resin 3 having polyester units. The content of the polyester unit component in Resin 3 concerned was found to be 100% by mass. The physical properties of Resin 3 having polyester units are shown in Table 2.

Production Example 4 of the Resin Having Polyester Units

There was adopted the same manner as in the production example 3 of the resin, except that in place of 1.0 g of aromatic carboxylic acid titanium compound 3, 0.1 g of aromatic carboxylic acid titanium compound 10 was used, to yield Resin 4 having polyester units. The content of the polyester unit component in Resin 4 concerned was found to be 100% by mass. The physical properties of Resin 4 having polyester units are shown in Table 2.

Production Example 5 of the Resin Having Polyester Units

There was adopted the same manner as in the production example 3 of the resin, except that in place of 1.0 g of aromatic carboxylic acid titanium compound 3, 0.5 g of aromatic carboxylic acid titanium compound 2 was used, to yield Resin 5 having polyester units. The content of the polyester unit component in Resin 5 concerned was found to be 100% by mass. The physical properties of Resin 5 having polyester units are shown in Table 2.

Production Example 6 of the Resin Having Polyester Units

There was adopted the same manner as in the production example 3 of the resin, except that in place of 1.0 g of aromatic carboxylic acid titanium compound 3, 0.6 g of aromatic carboxylic acid titanium compound 5 and 1.0 g of titanium tetramethoxide were used, to yield Resin 6 having polyester units. The content of the polyester unit component in Resin 6 concerned was found to be 100% by mass. The physical properties of Resin 6 having polyester units are shown in Table 2.

Production Example 7 of the Resin Having Polyester Units

There was adopted the same manner as in the production example 3 of the resin, except that in place of 1.0 g of aromatic carboxylic acid titanium compound 3, 0.2 g of aromatic carboxylic acid titanium compound 6 and 0.4 g of aromatic diol titanium compound 1 were used, to yield Resin 7 having polyester units. The content of the polyester unit component in Resin 7 concerned was found to be 100% by mass. The physical properties of Resin 7 having polyester units are shown in Table 2.

Production Example 8 of the Resin Having Polyester Units

There was adopted the same manner as in the production example 3 of the resin, except that in place of 1.0 g of aromatic carboxylic acid titanium compound 3, 1.0 g of aromatic carboxylic acid titanium compound 7, 0.1 g of aromatic carboxylic acid titanium compound 6, and 0.1 g of magnesium carbonate were used, to yield Resin 8 having polyester units. The content of the polyester unit component in Resin 8 concerned was found to be 100% by mass. The physical properties of Resin 8 having polyester units are shown in Table 2.

Production Example 9 of the Resin Having Polyester Units

There was adopted the same manner as in the production example 3 of the resin, except that in place of 1.0 g of aromatic carboxylic acid titanium compound 3, 0.5 g of aromatic carboxylic acid titanium compound 8 was used, to yield Resin 9 having polyester units. The content of the polyester unit component in Resin 9 concerned was found to be 100% by mass. The physical properties of Resin 9 having polyester units are shown in Table 2.

Production Example 10 of the Resin Having Polyester Units

There was adopted the same manner as in the production example 3 of the resin, except that in place of 1.0 g of aromatic carboxylic acid titanium compound 3, 0.4 g of aromatic carboxylic acid titanium compound 9 was used, to yield Resin 10 having polyester units. The content of the polyester unit component in Resin 10 concerned was found to be 100% by mass. The physical properties of Resin 10 having polyester units are shown in Table 2.

Comparative Production Example 1 of the Resin Having Polyester Units

There was adopted the same manner as in the production example 3 of the resin, except that in place of aromatic carboxylic acid titanium compound 3, tetramethyl titanate was used, to yield Resin 11 having polyester units. The content of the polyester unit component in Resin 11 concerned was found to be 100% by mass. The physical properties of Resin 11 having polyester units are shown in Table 2.

Comparative Production Example 2 of the Resin Having Polyester Units

There was adopted the same manner as in the production example 3 of the resin, except that in place of aromatic carboxylic acid titanium compound 3, dioctyltin oxide was used, to yield Resin 12 having polyester units. The content of the polyester unit component in Resin 12 concerned was found to be 100% by mass. The physical properties of Resin 12 having polyester units are shown in Table 2.

Production Example 1 of the Resin Having Vinyl Units

| | |
|---|---|
| Styrene | 78.9 parts by mass |
| n-Butyl acrylate | 19.7 parts by mass |
| Monobutyl maleate | 1.4 parts by mass |

-continued

| | |
|---|---|
| Di-tert-butyl peroxide | 1.0 part by mass |
| Aromatic carboxylic acid titanium compound 1 | 1.0 part by mass |

The above starting materials were dropped into 200 parts by mass of heated xylene over a period of 4 hours. Polymerization was completed under reflux of xylene, and then the solvent was distilled off under reduced pressure. The resin thus obtained will be referred to as Resin 1 having vinyl units. The content of the polyester unit component in Resin 1 concerned is found to be 0% by mass. The physical properties of Resin 1 having vinyl units are shown in Table 2.

TABLE 2

| | Catalyst(s) | Mw ($\times 10^3$) | Mn ($\times 10^3$) | Mw/Mn | Tg (° C.) | Softening point Tm (° C.) | Acid value (mg KOH/g) |
|---|---|---|---|---|---|---|---|
| Resin 1 having polyester units | Aromatic carboxylic acid titanium compound 3<br>Potassium titanyl oxalate | 28 | 3.2 | 8.8 | 62 | 110 | 31 |
| Resin 2 having polyester units | Aromatic carboxylic acid titanium compound 1<br>Aromatic carboxylic acid titanium compound 4 | 80 | 3.5 | 22.9 | 61 | 108 | 30 |
| Resin 3 having polyester units | Aromatic carboxylic acid titanium compound 3 | 40 | 3.2 | 12.5 | 62 | 111 | 32 |
| Resin 4 having polyester units | Aromatic carboxylic acid titanium compound 10 | 28 | 2.8 | 10.0 | 60 | 108 | 31 |
| Resin 5 having polyester units | Aromatic carboxylic acid titanium compound 2 | 35 | 3.1 | 11.3 | 61 | 110 | 32 |
| Resin 6 having polyester units | Aromatic carboxylic acid titanium compound 5<br>Titanium tetramethoxide | 28 | 2.3 | 12.2 | 61 | 108 | 32 |
| Resin 7 having polyester units | Aromatic carboxylic acid titanium compound 6<br>Aromatic diol titanium compound 1 | 32 | 3.5 | 9.1 | 60 | 108 | 31 |
| Resin 8 having polyester units | Aromatic carboxylic acid titanium compound 6<br>Aromatic carboxylic acid titanium compound 7<br>Magnesium carbonate | 36 | 3.5 | 10.3 | 62 | 105 | 32 |
| Resin 9 having polyester units | Aromatic carboxylic acid titanium compound 8 | 39 | 3.4 | 11.5 | 61 | 110 | 32 |
| Resin 10 having polyester units | Aromatic carboxylic acid titanium compound 9 | 28 | 2.1 | 13.3 | 60 | 110 | 31 |
| Resin 11 having polyester units | Tetramethyl titanate | 43 | 3.4 | 12.6 | 61 | 115 | 30 |
| Resin 12 having polyester units | Dioctyltin oxide | 42 | 3.4 | 12.4 | 62 | 114 | 32 |
| Resin 1 having vinyl units | Aromatic carboxylic acid titanium compound 1 | 12 | 6.4 | 1.9 | 28 | 118 | 4.6 |

Example 1

Magenta toner 1 was prepared in the following manner.

(First Kneading Step)

| | |
|---|---|
| Resin 1 having polyester units | 50 parts by mass |
| C. I. Pigment Violet 19 (powder) | 50 parts by mass |
| Distilled water | 50 parts by mass |

The above starting materials were placed in a kneader type mixer and the temperature of the mixture thus obtained was raised under mixing without applying any pressure. When the temperature reached the highest temperature (It is inevitably determined by the boiling point of the solvent in the paste, falling in a range from about 90 to 100° C. in this case.), the pigment in the aqueous phase is partitioned or transferred into the molten resin phase; after confirmation of this partition or transfer, the mixture was further heated and melt-kneaded for 30 minutes so as for the pigment in the paste to be sufficiently transferred. Thereafter, the mixer was once stopped, and the hot water was discharged. Then, the mixture was further heated up to 110° C. and melt-kneaded at this temperature for about 30 minutes, so that the pigment was dispersed and the moisture was distilled off. After completion of this step, the kneaded product was cooled and taken out to yield a first kneaded product.

(Second Kneading Step)

| | |
|---|---|
| Above first kneaded product (the content of the pigment particles: 50% by mass) | 10 parts by mass |
| Resin 1 having polyester units | 100 parts by mass |
| Paraffin wax (the maximum endothermic peak: 75.7° C.; Mw: 500; Mn: 380; the main peak molecular weight: 450) | 3.0 parts by mass |
| 3,5-Di-tert-butylsalicylic acid aluminum compound | 1.0 part by mass |

The starting materials as prescribed above were fully premixed by means of a Henschel mixer, and the mixture thus obtained was melt-kneaded at the temperature set at 150° C., by means of a twin-screw extrusion kneader. The kneaded product was cooled and thereafter crushed by means of a hammer mill so as to be about 1 to 2 mm in particle diameter, and then finely pulverized by means of an air-jet pulverizer so as to be 20 μm or less in particle diameter. The finely pulverized product thus obtained was classified. The classified powder was spheroidized by use of a mechanofusion system provided with a cooling mechanism such as a chiller unit, to yield magenta resin particles (toner particles) having a weight average particle diameter (D4) of 7.2 μm in the particle size distribution. Thereafter, as inorganic fine particles, 0.8 part by mass of surface treated fine titanium oxide particles of 50 nm in primary average particle diameter which were surface-treated with isobutyltrimethoxysilane and 0.6 part by mass of a hydrophobic silica were externally added to and mixed with the toner particles to yield Magenta Toner 1, the hydrophobic silica being obtained by successively treating 100 parts by mass of fine silica particles (BET specific surface area: 200 $m^2/g$), produced by a dry process, with 5 parts by mass of dimethyldichlorosilane, 15 parts by mass of hexamethylenedisilazane and 10 parts by mass of dimethylsilicone oil. The physical properties of Magenta Toner 1 is shown in Table 3.

Magenta Toner 1 was further blended with magnetic ferrite carrier particles (number average particle diameter: 50 μm), surface-coated with silicone resin, so as for the toner concentration to be 6% by mass, to yield Two-component Magenta Developer 1. It is to be noted that the content of the polyester unit component in the whole binder resin component in Magenta Toner 1 thus obtained was 100% by mass. Two-component Magenta Developer 1 thus obtained was subjected to the following evaluations.

(Evaluation of Long-term Charge Stability).

Two-component Magenta Developer 1 was charged in the developing unit of a full-color copying machine CLC-5000 (manufactured by Canon Inc.), modified for test in such a way that an oil application mechanism in the fixing unit thereof was removed. Thus, a long-term 50,000-sheet running test was carried out in a monochromatic mode, using an original with an image area proportion of 7%, in each of a high-temperature/high-humidity environment (H/H; temperature: 30° C./humidity: 80%), a normal-temperature/low-humidity environment (N/L; temperature: 23° C./humidity: 5%), and a normal-temperature/normal-humidity environment (N/N; temperature: 23° C./humidity: 60%). The triboelectric charge quantity (mC/kg) of the developer on the developing sleeve at the initial stage (INI) and that after 50,000-sheet running in each of the above described environments were measured. The method for measuring the triboelectric charge quantity of a developer on the developing sleeve will be described below in detail.

FIG. 1 is a schematic view of an apparatus for measuring the triboelectric charge quantity of a two-component developer. In a measurement vessel 2 made of a metal having a screen 1 of 30 μm in mesh opening at the bottom thereof, 0.5 to 1.5 g of a two-component developer collected from the sleeve is placed and the vessel is covered with a metal lid 3. The mass of the entire measurement vessel 2 in this condition is measured to be denoted by W1 (g). Next, in a suction device 4 (at least the portion thereof to be in contact the measurement vessel 2 is made of an insulator), suction is carried out from a suction opening 5 and the pressure on a vacuum gauge 7 is set at 4 kPa by controlling an air flow valve 6. Under this condition, the toner is removed fully by suction, preferably by suction for about 2 minutes. The potential indicated on a potentiometer 8 at this time is denoted by V (volt). Here, the reference numeral 9 denotes a capacitor, the capacitance thereof being denoted by C (μF). The mass of the entire measurement vessel on completion of suction is measured to be denoted by W2 (g). The triboelectric charge quantity (mC/kg) of the toner is derived as shown in the following formula.

$$\text{Triboelectric charge quantity of a two-component developer (mC/kg)} = C \times V/(W1 - W2)$$

From the triboelectric charge quantity thus obtained, the charge stability of the Two-component Magenta Developer 1 was evaluated on the basis of the following evaluation criteria. The evaluation results obtained are shown in Table 4.

(Evaluation Criteria)

A: The difference Δ in triboelectric charge quantity between at the initial stage and after 50,000-sheet running is less than 5 (mC/kg).

B: The difference Δ in triboelectric charge quantity between at the initial stage and after 50,000-sheet running is 5 or more and less than 10 (mC/kg), causing no practical problem.

C: The difference Δ in triboelectric charge quantity between at the initial stage and after 50,000-sheet running is 10 or more and less than 15 (mC/kg), leading to somewhat undesirable effects in charge stability, but causing no practical problem.

D: The difference Δ in triboelectric charge quantity between at the initial stage and after 50,000-sheet running is 15 (mC/kg) or more.

(Evaluation of OHP Transparency)

For the measurement of the OHP transparency, a Shimadzu automatic recording spectrophotometer UV2200 (manufactured by Shimadzu Corp.) was used. The transmittance of the OHP film alone is set at 100%. The transmittance measurement was made at the maximum absorption wavelength for each of the toners, namely, at 650 nm for a magenta toner, at 500 nm for a cyan toner and at 600 nm for a yellow toner. The results were evaluated on the basis of the following criteria. The evaluation results obtained are shown in Table 4.

A: 85% or more

B: 75% or more and less than 85%

C: 65% or more and less than 75%

D: less than 65%

(Evaluation of Fixing Property)

A test for determining a fixing temperature range was made by use of a color copying machine CLC-5000 (manufactured by Canon Inc.), modified for test in such a way that an oil application mechanism thereof was removed and the fixing temperature was made optionally variable. Unfixed images were produced in a monochromatic mode in a normal-temperature/normal-humidity environment (23° C./50 to 60%) by controlling the development contrast in such a way that the toner quantity laid on paper was 1.2 mg/cm$^2$. The unfixed images were formed with an image area proportion of 25% on A4 sheets (SK80, paper recommended for CLC). Thereafter, the unfixed images were fixed in a normal-temperature/normal-humidity environment (23° C./50 to 60%) by raising the fixing temperature from 120° C. with an increment of 5° C. Thus, the temperature width in which neither offsetting nor twining of paper occurs was taken as the fixable range. The evaluation results obtained are shown in Table 4.

(Evaluation of Transfer Efficiency)

The transfer efficiency was evaluated in the following manner. By use of a commercially available color copying machine CLC-5000 (manufactured by Canon Inc.), modified for test in such a way that a cleaner for the photosensitive drum was installed in the developing unit, an image was formed on the basis of a chart capable of forming a plurality of circular images or a plurality of strip-shaped images. The residual untransferred toner left on the drum was stripped off by taping with a tape, and then the tape was stuck to paper, the image density thereof being denoted by D1. The image density of the taped portion of a toner image transferred on paper was denoted by D2. The transfer efficiency was derived on the basis of the following formula. The transfer efficiency at the initial stage and that after 50,000-sheet running were measured in a normal-temperature/normal-humidity (N/N) environment (23° C./50%)

$$\text{Transfer efficiency (\%)} = D2/(D1+D2)\times 100$$

The transfer efficiencies thus obtained were evaluated on the basis of the following evaluation criteria.

A: The difference Δ in transfer efficiency between at the initial stage and after 50,000-sheet running is less than 5%.

B: The difference Δ in transfer efficiency between at the initial stage and after 50,000-sheet running is 5% or more and less than 10%.

C: The difference Δ in transfer efficiency between at the initial stage and after 50,000-sheet running is 10% or more and less than 15%.

D: The difference Δ in transfer efficiency between at the initial stage and after 50,000-sheet running is 15% or more.

Example 2

Magenta Toner 2 was prepared in the same manner as in Example 1 except that Resin 2 having polyester units was used as a binder resin in place of Resin 1 having polyester units, behenyl behenate (the maximum endothermic peak: 71.4° C.) was used as a wax in place of paraffin wax, and 1.0 part by mass of salicylic acid zirconium compound (TN-105, manufactured by Hodogaya Chemical Co., Ltd.) was used as a charge control agent in place of 3,5-di-tert-butylsalicylic acid aluminum compound; and Two-component Magenta Developer 2 was also obtained. The content of the polyester unit component in the whole binder resin component of Magenta Toner 2 was 90% by mass. The physical properties of Magenta Toner 2 are shown in Table 3. Two-component Magenta Developer 2 was evaluated in the same manner as in Example 1 with respect to the long-term charge stability, the OHP transparency, the fixing property and the transfer efficiency. The evaluation results obtained are shown in Table 4.

Example 3

Magenta Toner 3 was prepared in the same manner as in Example 1 except for the modification that Resin 3 having polyester units was used as a binder resin and an alcohol-terminated polyethylene wax (the maximum endothermic peak: 108.9° C.; Mw: 830; Mn: 470; main peak molecular weight: 780) was used as a wax; and Two-component Magenta Developer 3 was also obtained. The content of the polyester unit component in the whole binder resin component of Magenta Toner 3 was 100% by mass. The physical properties of Magenta Toner 3 are shown in Table 3. Two-component Magenta Developer 3 was evaluated in the same manner as in Example 1 with respect to the long-term charge stability, the OHP transparency, the fixing property and the transfer efficiency. The evaluation results obtained are shown in Table 4.

Example 4

Magenta Toner 4 was prepared in the same manner as in Example 1 except for the modification that Resin 4 having polyester units was used as a binder resin and Fischer-Tropsch wax (the maximum endothermic peak: 77.5° C.; Mw: 520; Mn: 450; main peak molecular weight: 490) was used as a wax; and Two-component Magenta Developer 4 was also obtained. The content of the polyester unit component in the whole binder resin component of Magenta Toner 4 was 100% by mass. The physical properties of Magenta Toner 4 are shown in Table 3. Two-component Magenta Developer 4 was evaluated in the same manner as in Example 1 with respect to the long-term charge stability, the OHP transparency, the fixing property and the transfer efficiency. The evaluation results obtained are shown in Table 4.

Example 5

Magenta Toner 5 was prepared in the same manner as in Example 1 except for the modification that Resin 5 having polyester units was used as a binder resin; and Two-component Magenta Developer 5 was also obtained. The content of the polyester unit component in the whole binder resin component of Magenta Toner 5 was 100% by mass. The physical properties of Magenta Toner 5 are shown in Table 3. Two-component Magenta Developer 5 was evaluated in the same manner as in Example 1 with respect to the long-term charge stability, the OHP transparency, the fixing property and the transfer efficiency. The evaluation results obtained are shown in Table 4.

Example 6

Magenta Toner 6 was prepared in the same manner as in Example 1 except for the modification that 90 parts by mass of Resin 6 having polyester units and 10 parts by mass of Resin 1 having vinyl units were used as a binder resin; and Two-component Magenta Developer 6 was also obtained. The content of the polyester unit component in the whole binder resin component of Magenta Toner 6 was 90% by mass. The physical properties of Magenta Toner 6 are shown in Table 3. Two-component Magenta Developer 6 was evaluated in the same manner as in Example 1 with respect to the long-term charge stability, the OHP transparency, the fixing property and the transfer efficiency. The evaluation results obtained are shown in Table 4.

Example 7

Magenta Toner 7 was prepared in the same manner as in Example 1 except for the modification that 90 parts by mass of Resin 7 having polyester units and 10 parts by mass of Resin 1 having vinyl units were used as a binder resin, and a polyethylene wax (the maximum endothermic peak: 126° C.; Mw: 2450; Mn: 1600; main peak molecular weight: 2200) was used as a wax; and Two-component Magenta Developer 7 was also obtained. The content of the polyester unit component in the whole binder resin component of Magenta Toner 7 was 90% by mass. The physical properties of Magenta Toner 7 are shown in Table 3. Two-component Magenta Developer 7 was evaluated in the same manner as in Example 1 with respect to the long-term charge stability, the OHP transparency, the fixing property and the transfer efficiency. The evaluation results obtained are shown in Table 4.

Example 8

Magenta Toner 8 was prepared in the same manner as in Example 1 except for the modification that 90 parts by mass of Resin 8 having polyester units and 10 parts by mass of Resin 1 having vinyl units were used as a binder resin, and a polyethylene wax (the maximum endothermic peak: 126° C.; Mw: 2450; Mn: 1600; main peak molecular weight: 2200) was used as a wax; and Two-component Magenta Developer 8 was also obtained. The content of the polyester unit component in the whole binder resin component of Magenta Toner 8 was 90% by mass. The physical properties of Magenta Toner 8 are shown in Table 3. Two-component Magenta Developer 8 was evaluated in the same manner as in Example 1 with respect to the long-term charge stability, the OHP transparency, the fixing property and the transfer efficiency. The evaluation results obtained are shown in Table 4.

Example 9

Magenta Toner 9 was prepared in the same manner as in Example 1 except for the modification that 90 parts by mass of Resin 9 having polyester units and 10 parts by mass of Resin 1 having vinyl units were used as a binder resin, and a polyethylene wax (the maximum endothermic peak: 126° C.; Mw: 2450; Mn: 1600; main peak molecular weight: 2200) was used as a wax; and Two-component Magenta Developer 9 was also obtained. The content of the polyester unit component in the whole binder resin component of Magenta Toner 9 was 90% by mass. The physical properties of Magenta Toner 9 are shown in Table 3. Two-component Magenta Developer 9 was evaluated in the same manner as in Example 1 with respect to the long-term charge stability, the OHP transparency, the fixing property and the transfer efficiency. The evaluation results obtained are shown in Table 4.

Example 10

Magenta Toner 10 was prepared in the same manner as in Example 1 except for the modification that 90 parts by mass of Resin 10 having polyester units and 10 parts by mass of Resin 1 having vinyl units were used as a binder resin, and a polyethylene wax (the maximum endothermic peak: 126° C.; Mw: 2450; Mn: 1600; main peak molecular weight: 2200) was used as a wax; and Two-component Magenta Developer 10 was also obtained. The content of the polyester unit component in the whole binder resin component of Magenta Toner 10 was 90% by mass. The physical properties of Magenta Toner 10 are shown in Table 3. Two-component Magenta Developer 10 was evaluated in the same manner as in Example 1 with respect to the long-term charge stability, the OHP transparency, the fixing property and the transfer efficiency. The evaluation results obtained are shown in Table 4.

Comparative Example 1

Magenta Toner 11 was prepared in the same manner as in Example 10 except for the modification that 90 parts by mass of Resin 11 having polyester units and 10 parts by mass of Resin 1 having vinyl units were used as a binder resin; and Two-component Magenta Developer 11 was also obtained. The content of the polyester unit component in the whole binder resin component of Magenta Toner 11 was 90% by mass. The physical properties of Magenta Toner 11 are shown in Table 3. Two-component Magenta Developer 11 was evaluated in the same manner as in Example 1 with respect to the long-term charge stability, the OHP transparency, the fixing property and the transfer efficiency. The evaluation results obtained are shown in Table 4.

Comparative Example 2

Magenta Toner 12 was prepared in the same manner as in Example 10 except for the modification that 90 parts by mass of Resin 12 having polyester units and 10 parts by mass of Resin 1 having vinyl units were used as a binder resin; and Two-component Magenta Developer 12 was also obtained. The content of the polyester unit component in the whole binder resin component of Magenta Toner 12 was 90% by mass. The physical properties of Magenta Toner 12 are shown in Table 3. Two-component Magenta Developer 12 was evaluated in the same manner as in Example 1 with respect to the long-term charge stability, the OHP transparency, the fixing property and the transfer efficiency. The evaluation results obtained are shown in Table 4.

Comparative Example 3

Magenta Toner 13 was prepared in the same manner as in Example 10 except for the modification that 100 parts by mass of Resin 1 having vinyl units was used as a binder resin; and Two-component Magenta Developer 13 was also obtained. Magenta Toner 13 did not contain the polyester unit component. The physical properties of Magenta Toner 13 are shown in Table 3. Two-component Magenta Developer 13 was evaluated in the same manner as in Example 1 with respect to the long-term charge stability, the OHP transparency, the fixing property and the transfer efficiency. The evaluation results obtained are shown in Table 4.

Example 11

Cyan Toner 1 was prepared in the same manner as in Example 1 except that C. I. Pigment Blue 15:3 was used in place of C. I. Pigment Violet 19; and Two-component Cyan Developer 1 was also obtained. The content of the polyester unit component in the whole binder resin component of Cyan Toner 1 was 100% by mass. The physical properties of Cyan Toner 1 are shown in Table 3. Two-component Cyan Developer 1 was evaluated in the same manner as in Example 1 with respect to the long-term charge stability, the OHP transparency, the fixing property and the transfer efficiency. The evaluation results obtained are shown in Table 4.

Example 12

Yellow Toner 1 was prepared in the same manner as in Example 1 except that C. I. Pigment Yellow 180 was used in place of C. I. Pigment Violet 19; and Two-component Yellow Developer 1 was also obtained. The content of the polyester unit component in the whole binder resin component of Yellow Toner 1 was 100% by mass. The physical properties of Yellow Toner 1 are shown in Table 3. Two-component Yellow Developer 1 was evaluated in the same manner as in Example 1 with respect to the long-term charge stability, the OHP transparency, the fixing property and the transfer efficiency. The evaluation results obtained are shown in Table 4.

Example 13

Black Toner 1 was prepared in the same manner as in Example 1 except that carbon black (primary average particle diameter: 31 nm; pH 9.5; DBP oil absorption: 42 ml/100 g) was used in place of C. I. Pigment Violet 19; and Two-component Black Developer 1 was also obtained. The content of the polyester unit component in the whole binder resin component of Black Toner 1 was 100% by mass. The physical properties of Black Toner 1 are shown in Table 3. Two-component Black Developer 1 was evaluated in the same manner as in Example 1 with respect to the long-term charge stability, the OHP transparency, the fixing property and the transfer efficiency. The evaluation results obtained are shown in Table 4.

Example 14

Magenta Toner 1 prepared in Example 1 was used as a one-component developer, and the evaluation of the long-term charge stability for the case of image formation conducted on the basis of the one-component developing mode was carried out in the following manner.

(Evaluation of Long-term Charge Stability)

Evaluation was made by use of a commercially available color laser printer, LBP2300 (manufactured by Canon Inc.). In the magenta cartridge of the printer, 300 g of Magenta Toner 1 was charged, and a 5000-sheet continuous printing was carried out in a monochromatic mode at a printing ratio of 5% in each of a high-temperature/high-humidity environment, a normal-temperature/low-humidity environment and a normal-temperature/normal-humidity environment. The triboelectric charge quantity on the developing sleeve at the initial stage and that after 5000-sheet running in each of the above described environments were measured. The method for measuring the triboelectric charge quantity on the developing sleeve will be described below in detail with reference to an accompanying drawing.

Figure 2:
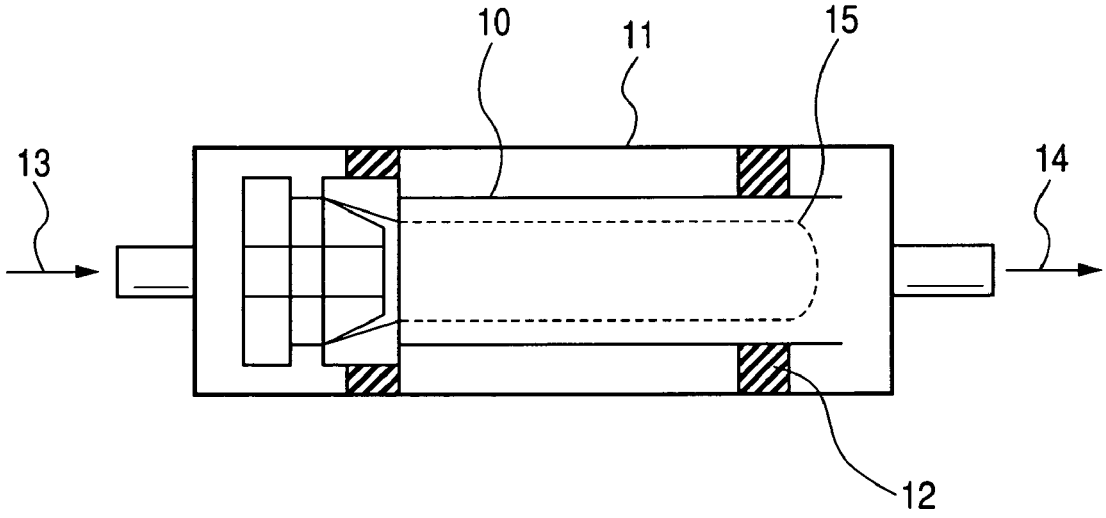
FIG. 2 is a schematic view of an apparatus for measuring the triboelectric charge quantity of a one-component developer.

FIG. 2 is a schematic view of an apparatus for measuring the triboelectric charge quantity of a one-component developer. The triboelectric charge quantity of a one-component developer can be measured, for example, by use of a Faraday-Cage as shown in FIG. 2. A Faraday Cage means a set of coaxial double cylinders, the inner cylinder and the outer cylinder being insulated from each other. When a charged body having a charge quantity of Q is placed in the inner cylinder, electrostatic induction creates the same condition as if there were a metal cylinder having a charge quantity of Q. The induced charge quantity is measured by means of a KEITHLEY 616 DIGITAL ELECTROMETER, and the value obtained from the charge quantity Q divided by the mass M of the toner placed in the inner cylinder, namely, (Q/M) is taken as the triboelectric charge quantity. The developer 13 is directly taken from a developer bearing member into a filter by air suction.

Triboelectric charge quantity of a one-component developer (mC/kg)=$Q/M$

From the obtained triboelectric charge quantities, the charge stability of Magenta Toner 1 as a one-component developer was evaluated on the basis of the following criteria. The evaluation results obtained are shown in Table 4.

(Evaluation Criteria)

A: The difference Δ in triboelectric charge quantity between at the initial stage and after 5000-sheet running is less than 5 (mC/kg).

B: The difference Δ in triboelectric charge quantity between at the initial stage and after 5000-sheet running is 5 or more and less than 10 (mC/kg), causing no practical problem.

C: The difference Δ in triboelectric charge quantity between at the initial stage and after 5000-sheet running is 10 or more and less than 15 (mC/kg), leading to somewhat undesirable effects in charge stability, but causing no practical problem.

D: The difference Δ in triboelectric charge quantity between at the initial stage and after 5000-sheet running is 15 (mC/kg) or more.

TABLE 3

| | Content of polyester unit component (% by mass) | Catalyst(s) | Wax | Transmittance in 45% methanol (%) | DSC maximum endothermic peak (° C.) |
|---|---|---|---|---|---|
| Magenta Toner 1 | 100 | Aromatic carboxylic acid titanium compound 3<br>Potassium titanyl oxalate | Paraffin wax (maximum endothermic peak: 75.7° C.) | 45 | 75.6 |
| Magenta Toner 2 | 90 | Aromatic carboxylic acid titanium compound 1<br>Aromatic carboxylic acid titanium compound 4 | Behenyl behenate (maximum endothermic peak: 71.4° C.) | 50 | 71.0 |
| Magenta Toner 3 | 100 | Aromatic carboxylic acid titanium compound 3 | Alcohol-terminated polyethylene wax (maximum endothermic peak: 108.9° C.) | 61 | 106.4 |
| Magenta Toner 4 | 100 | Aromatic carboxylic acid titanium compound 10 | Fischer-Tropsch wax (maximum endothermic peak: 77.5° C.) | 65 | 76.5 |
| Magenta Toner 5 | 100 | Aromatic carboxylic acid titanium compound 2 | Paraffin wax (maximum endothermic peak: 75.7° C.) | 60 | 75.4 |
| Magenta Toner 6 | 90 | Aromatic carboxylic acid titanium compound 5<br>Titanium tetramethoxide | Paraffin wax (maximum endothermic peak: 75.7° C.) | 48 | 74.8 |
| Magenta Toner 7 | 90 | Aromatic carboxylic acid titanium compound 6<br>Aromatic diol titanium compound 1 | Polyethylene wax (maximum endothermic peak: 126° C.) | 58 | 123.4 |
| Magenta Toner 8 | 90 | Aromatic carboxylic acid titanium compound 6<br>Aromatic carboxylic acid titanium compound 7<br>Magnesium carbonate | Polyethylene wax (maximum endothermic peak: 126° C.) | 56 | 124.3 |
| Magenta Toner 9 | 90 | Aromatic carboxylic acid titanium compound 8 | Polyethylene wax (maximum endothermic peak: 126° C.) | 63 | 123.8 |
| Magenta Toner 10 | 90 | Aromatic carboxylic acid titanium compound 9 | Polyethylene wax (maximum endothermic peak: 126° C.) | 65 | 123.8 |
| Magenta Toner 11 | 90 | Tetramethyl titanate | Polyethylene wax (maximum endothermic peak: 126° C.) | 75 | 124.4 |
| Magenta Toner 12 | 90 | Dioctyltin oxide | Polyethylene wax (maximum endothermic peak: 126° C.) | 73 | 124.3 |
| Magenta Toner 13 | 0 | Aromatic carboxylic acid titanium compound 1 | Polyethylene wax (maximum endothermic peak: 126° C.) | 71 | 124.0 |
| Cyan Toner 1 | 100 | Aromatic carboxylic acid titanium compound 3<br>Potassium titanyl oxalate | Paraffin wax (maximum endothermic peak: 75.7° C.) | 48 | 75.0 |
| Yellow Toner 1 | 100 | Aromatic carboxylic acid titanium compound 3<br>Potassium titanyl oxalate | Paraffin wax (maximum endothermic peak: 75.7° C.) | 45 | 75.6 |
| Black Toner 1 | 100 | Aromatic carboxylic acid titanium compound 3<br>Potassium titanyl oxalate | Paraffin wax (maximum endothermic peak: 75.7° C.) | 44 | 74.9 |

TABLE 4

Evaluation results (long-term charge stability, OHP transparency, fixing property and transfer efficiency)

| | Long-term charge stability (mC/kg) | | | | | | | | | | | | OHP transparency | Fixing temperature width | Transfer efficiency |
|---|---|---|---|---|---|---|---|---|---|---|---|---|---|---|---|
| | H/H | | | | N/L | | | | N/N | | | | (%) | (° C.) | (%) |
| | INI. | 50 k | Δ | Evaluation | INI. | 50 k | Δ | Evaluation | INI. | 50 k | Δ | Evaluation | Evaluation | Evaluation | Evaluation |
| Two component | | | | | | | | | | | | | | | |
| Ex. 1 | 20.3 | 17.3 | 3.0 | A | 30.2 | 28.3 | 1.9 | A | 25.6 | 23.5 | 2.1 | A | 90% (A) | 130-200 | 2% (A) |
| Ex. 2 | 19.2 | 15.4 | 3.8 | A | 31.8 | 30.2 | 1.6 | A | 24.6 | 22.6 | 2.0 | A | 88% (A) | 125-195 | 5% (B) |
| Ex. 3 | 21.2 | 14.9 | 6.3 | B | 30.6 | 26.5 | 4.1 | A | 26.5 | 21.5 | 5.0 | B | 83% (B) | 135-205 | 9% (B) |
| Ex. 4 | 20.1 | 14.3 | 5.8 | B | 29.8 | 22.5 | 7.3 | B | 24.6 | 17.3 | 7.3 | B | 78% (B) | 130-200 | 10% (B) |
| Ex. 5 | 18.3 | 10.3 | 8.0 | B | 29.4 | 23.2 | 6.2 | B | 26.5 | 20.5 | 6.0 | B | 81% (B) | 130-200 | 10% (B) |
| Ex. 6 | 19.3 | 15.1 | 4.2 | A | 30.2 | 27.6 | 2.6 | A | 24.3 | 21.7 | 2.6 | A | 86% (A) | 130-200 | 4% (A) |
| Ex. 7 | 22.3 | 16.3 | 6.0 | B | 31.5 | 28.3 | 3.2 | A | 26.3 | 21.8 | 4.5 | A | 84% (B) | 135-195 | 6% (B) |
| Ex. 8 | 21.2 | 15.3 | 5.9 | B | 32.6 | 28.9 | 3.7 | A | 24.5 | 20.3 | 4.2 | A | 85% (A) | 135-195 | 7% (B) |
| Ex. 9 | 20.6 | 13.5 | 7.1 | B | 30.6 | 22.4 | 8.2 | B | 26.3 | 18.6 | 7.7 | B | 77% (B) | 135-195 | 11% (C) |
| Ex. 10 | 20.4 | 9.8 | 10.6 | C | 30.5 | 21.8 | 8.7 | B | 24.6 | 16.7 | 7.9 | B | 75% (B) | 135-195 | 12% (C) |
| Comp. Ex. 1 | 21.3 | 7.8 | 13.5 | C | 31.6 | 20.1 | 11.5 | C | 26.4 | 13.6 | 12.8 | C | 71% (C) | 145-190 | 15% (C) |
| Comp. Ex. 2 | 22.5 | 10.6 | 11.9 | C | 32.5 | 21.6 | 10.9 | C | 25.4 | 15.2 | 10.2 | C | 68% (C) | 140-195 | 17% (D) |
| Comp. Ex. 3 | 21.4 | 5.6 | 15.8 | D | 33.5 | 22.6 | 10.9 | C | 27.3 | 14.3 | 13.0 | C | 65% (C) | 150-160 | 14% (C) |
| Ex. 11 | 19.8 | 16.3 | 3.5 | A | 29.8 | 28.3 | 1.5 | A | 26.4 | 24.3 | 2.1 | A | 90% (A) | 130-200 | 3% (A) |
| Ex. 12 | 21.3 | 17.3 | 4.0 | A | 31.5 | 29.1 | 2.4 | A | 25.3 | 22.6 | 2.7 | A | 88% (A) | 130-200 | 4% (A) |
| Ex. 13 | 22.2 | 18.9 | 3.3 | A | 32.6 | 29.8 | 2.8 | A | 26.4 | 23.6 | 2.8 | A | — | 130-200 | 3% (A) |

TABLE 4-continued

| Evaluation results (long-term charge stability, OHP transparency, fixing property and transfer efficiency) | | | | | | | | | | | | | | | |
|---|---|---|---|---|---|---|---|---|---|---|---|---|---|---|---|
| | Long-term charge stability (mC/kg) | | | | | | | | | | | | OHP transparency | Fixing temperature width | Transfer efficiency |
| | H/H | | | | N/L | | | | N/N | | | | (%) | (° C.) | (%) |
| | INI. | 50 k | Δ | Evaluation | INI. | 50 k | Δ | Evaluation | INI. | 50 k | Δ | Evaluation | Evaluation | Evaluation | Evaluation |
| One component | | | | | | | | | | | | | | | |
| Ex. 14 | 20.1 | 18.3 | 1.8 | A | 29.8 | 28.6 | 1.2 | A | 25.3 | 24.3 | 1.0 | A | 90% (A) | 130-200 | 3% (A) |

Example 15

By use of Two-component Magenta Developer 1 prepared in Example 1, Two-component Cyan Developer 1 prepared in Example 11, Two-component Yellow Developer 1 prepared in Example 12 and Two-component Black Developer 1 prepared in Example 13, and by means of a full-color copying machine CLC-5000 (manufacture by Canon Inc.), modified for test in such a way that an oil application mechanism in the fixing unit thereof was removed, thus, a long-term 50,000-sheet running test was carried out in a full-color mode, using an original with an image area proportion of 28%, in each of a high-temperature/high-humidity environment, a normal-temperature/low-humidity environment, and a normal-temperature/normal-humidity environment. Consequently, the charge stability in the long-term service test was satisfactory and satisfactory images were obtained in each of the above environments.

This application claims priority from Japanese Patent Application No. 2004-132899 filed Apr. 28, 2004, which is hereby incorporated by reference herein.

What is claimed is:

1. A toner for forming a full-color image comprising at least:

toner particles containing a binder resin, a colorant and a wax, and inorganic fine particles, wherein:

said binder resin comprises a resin having polyester units which is synthesized by use of an aromatic carboxylic acid titanium compound as a catalyst; and said inorganic fine particles comprise fine titanium oxide particles and fine silica particles.

2. The toner according to claim 1, wherein the transmittance (%) thereof in an aqueous solution of 45% by volume of methanol falls within a range from 10% to 70%.

3. The toner according to claim 1, wherein, in an endothermic curve thereof in differential scanning calorimetry (DSC), a temperature at which a maximum endothermic peak is exhibited in a temperature range from 30° C. to 200° C. falls within a range from 60° C. to 130° C.

4. The toner according to claim 1, wherein said aromatic carboxylic acid titanium compound is a reaction product between an aromatic carboxylic acid and a titanium alkoxide.

5. The toner according to claim 4, wherein said aromatic carboxylic acid is a di or more valent aromatic carboxylic acid and/or an aromatic oxycarboxylic acid.

6. The toner according to claim 4, wherein said titanium alkoxide is a compound represented by the following general formula (1):

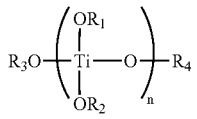

(1)

wherein $R_1$, $R_2$, $R_3$ and $R_4$ each are an alkyl group having 1 to 20 carbon atoms, and may be either the same or different from each other and optionally substituted; and n represents an integer of 1 to 10.

* * * * *